US008534643B2

(12) United States Patent
Lombardi et al.

(10) Patent No.: US 8,534,643 B2
(45) Date of Patent: Sep. 17, 2013

(54) WELDED HAMMER

(75) Inventors: Keith M. Lombardi, Avon, CT (US); Joshua Brown, Beacon Falls, CT (US); Karl Vanderbeek, West Hartford, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 0 days.

(21) Appl. No.: 13/605,151

(22) Filed: Sep. 6, 2012

(65) Prior Publication Data

US 2013/0126808 A1 May 23, 2013

Related U.S. Application Data

(63) Continuation of application No. 13/316,325, filed on Dec. 9, 2011.

(60) Provisional application No. 61/562,873, filed on Nov. 22, 2011.

(51) Int. Cl.
*B25D 1/04* (2006.01)

(52) U.S. Cl.
USPC ..... 254/26 R; 254/21; 81/20

(58) Field of Classification Search
USPC ..... 269/26 R, 26 E, 21, 25; 81/20, 22, 81/18
See application file for complete search history.

(56) References Cited

U.S. PATENT DOCUMENTS

| | | | | |
|---|---|---|---|---|
| D45,761 | S * | 5/1914 | Miller | D8/76 |
| 2,884,816 | A | 5/1959 | Lay | |
| 5,142,948 | A | 9/1992 | Liou | |
| 5,860,334 | A | 1/1999 | Coonrad | |
| 5,988,019 | A * | 11/1999 | Coonrad | 81/20 |
| D420,268 | S | 2/2000 | Coonrad | |
| 6,131,488 | A * | 10/2000 | Coonrad | 81/20 |
| D442,048 | S | 5/2001 | Coonrad | |
| 6,460,430 | B2 * | 10/2002 | Coonrad | 81/20 |
| 6,615,691 | B2 * | 9/2003 | Coonrad | 81/20 |
| 6,786,472 | B1 * | 9/2004 | Dahl | 254/25 |
| 7,090,197 | B2 | 8/2006 | Stewart | |
| 7,134,363 | B2 | 11/2006 | Krallman | |
| 7,143,667 | B2 * | 12/2006 | Deros et al. | 81/20 |
| 7,404,346 | B2 * | 7/2008 | Youngren et al. | 81/20 |

(Continued)

FOREIGN PATENT DOCUMENTS

| | | |
|---|---|---|
| EP | 0932478 | 8/1999 |
| EP | 1 621 295 A1 | 2/2006 |

(Continued)

OTHER PUBLICATIONS

Photograph of Estwing E3-11 Milled Face Drywall Hammer (Round Face) (on information and belief, the actual E3-11 hammer is believed to be prior art), Feb. 12, 2013.

(Continued)

*Primary Examiner* — Lee D Wilson
(74) *Attorney, Agent, or Firm* — Pillsbury Winthrop Shaw Pittman LLP

(57) ABSTRACT

A hammer includes a handle and a head. The handle includes a bottom end and an upper end. The head is disposed on the upper end of the handle. The handle and the head are separately formed structures. The handle is formed from sheet metal.

36 Claims, 32 Drawing Sheets

(56) References Cited

U.S. PATENT DOCUMENTS

| | | | | |
|---|---|---|---|---|
| 7,621,503 | B2 * | 11/2009 | Warren et al. | 254/26 R |
| 8,047,099 | B2 | 11/2011 | St. John et al. | |
| 2003/0037641 | A1 | 2/2003 | Coonrad | 81/20 |
| 2005/0211962 | A1 | 9/2005 | Atkinson | |
| 2007/0006686 | A1 | 1/2007 | Warren | |
| 2008/0053278 | A1 | 3/2008 | St. John et al. | 81/20 |
| 2008/0178708 | A1 | 7/2008 | Wheat et al. | |
| 2010/0116096 | A1 * | 5/2010 | Hanlon | 81/22 |
| 2011/0120270 | A1 * | 5/2011 | Lombardi et al. | 81/22 |

FOREIGN PATENT DOCUMENTS

| | | |
|---|---|---|
| EP | 2324960 | 5/2011 |
| GB | 942909 | 11/1963 |
| JP | 55-147276 U | 10/1980 |
| ZA | 8203186 | 1/1983 |
| ZA | 8203186 | 3/1983 |

OTHER PUBLICATIONS

Photographs of Estwing Sure Strike All Steel 16, 20, and 22 oz. Metal Hammers (on information and belief, the actual hammers are believed to be prior art), Feb. 12, 2013.

Search Report as issued for European Patent Application No. 11195097.8, dated Jan. 31, 2013.

Weight Forward Rip Hammer (WF21LM), Estwing. [retrieved from the Internet]. Retrieved on Feb. 28, 2013. URL: <.amazon.com/each-Weight-Forward-Hammer-WF21LM/dp/B002YCL46Q/ref=sr__1__1__?ie=UTF8&qid=1362086268&sr=8-1&keywords=Weight+Forward+Rip+Hammer+%28WF21LM%29>.

Estwing WF21 Weight Forward Hammer with Fiberglass Handle, Estwing. [retrieved from the Internet]. Retrieved on Feb. 28, 2013. URL: amazon.com/Estwing-WF21LM-Weight-Forward-Fiberglass/dp/B0002JT0H8/ref=sr__1__1?s=UTF8qid=1362086373&sr=1-1&keywords=Estwing+WF21+Weight+Forward+Hammer+with+Fiberglass+Handle>.

Estwing #WF21L 21OZ Fiberglass Smooth Hammer, Estwing. [retrieved from the Internet]. Retrieved on Feb. 28, 2013, URL: .amazon.com/Estwing-WF21L-Fiberglass-Smooth-Hammer/dp/B0002JT0GY/ref=sr__1__1?s=hi&ie=UTF8&qid=1362086535&sr=1-1&keywords=Estwing+%23WF21L+21OZ+Fiberglass+Smooth+Hammer>.

Estwing WF21LM Weight Forward Hammer with Fiberglass Handle, Estwing. [retrieved from the Internet]. Retrieved on Feb. 28, 2013. URL: .amazon.com/Estwing-WF21LM-Weight-Forward-Fiberglass/dp/B0002JT0H8/ref=sr__1__1?s=hi&ie=UTF8&qid=1362086617&sr=1-1&keywords=Estwing+WF21LM+Weight+Forward+Hammer+with+Fiberglass+Handle>.

Estwing WF17L 17oz. Weight Forward Fiberglass Hammer, Estwing. [retrieved from the Internet]. Retrieved on Feb. 28, 2013, URL: <.amazon.com/Estwing-WF17L-Weight-Forward-Fiberglass/dp/B00047F3CE/ref=sr__1__1?s=hi&ie=UTF8&qid=1362086706&sr=1-1&keywords=Estwing+WF17L+17oz.+Weight+Forward+Fiberglass+Hammer>.

Office Action as issued for U.S. Appl. No. 12/827,484, dated Aug. 8, 2012.

"World's First 15 Ounce All-Steel, Framing Hammer", DeWALT Owners Group, Apr. 7, 2011. [retrieved from the Internet]. Retrieved on Feb. 13, 2013. URL: dewaltownersgroup.com/index.php?topic=672.0>.

DWHT51138—15 oz. MIG Weld Framing Hammer CF, DeWALT, Jul. 2011. [retrieved from the Internet]. Retrieved on Feb. 13, 2013. URL: dewalt.com/tools/hand-tools-hammers-and-pry-bars-framing-hammers-dwht51138.aspx.>.

15 oz. FatMax® Xtreme™ Weld Technology MiG Hammer, Stanley Hand Tools. [retrieved from the Internet]. Retrieved on Feb. 13, 2013. URL: stanleyhandtools.ca/hammers/15oz-mig-hammer.php>.

Extended Search Report as issued for European Patent Application No. 10192259.9, dated Feb. 24, 2011.

Amazon web page for Vaughan 13030/V5 Hammer retrieved Jun. 20, 2013 (Apr. 1, 2004).

Photographs of Douglas FR20S 20 Oz. Framing Hammer (actual hammer is admitted prior art) (Jun. 20, 2013).

Photographs of Vaughan V5 19 oz. Hammer (on information and belief, the actual hammer is prior art) (Jun. 20, 2013).

Douglas Superior by Design Tools; Wayback Machine Webpage.pdf dated Dec. 8, 2002.

* cited by examiner

SECTION A - A

SECTION B - B

SECTION C - C

SECTION D - D

SECTION E - E

SECTION F - F

| Stanley FatMax 15oz Framer | | | |
|---|---|---|---|
| Section | Claw Width "A" (mm) | Max Thickness (in predefined area) "B" | Ratio A/B |
| A-A | 22.7 | 5.1 | 4.5 |
| B-B | 22.3 | 5.1 | 4.4 |
| C-C | 22.3 | 5.1 | 4.4 |
| D-D | 22.4 | 5.1 | 4.4 |
| E-E | 22.9 | 5.1 | 4.5 |
| F-F | 24.0 | 5.1 | 4.7 |

TABLE 1

| Estwing 22oz 1pc Framer E3-22S | | | |
|---|---|---|---|
| Section | Claw Width "A" (mm) | Max Thickness (in defined area) "B" | Ratio A/B |
| A-A | 20.4 | 20.4 | 1.0 |
| B-B | 19.8 | 20.5 | 1.0 |
| C-C | 19.0 | 20.3 | 0.9 |
| D-D | 19.2 | 20.9 | 0.9 |
| E-E | 20.1 | 21.4 | 0.9 |
| F-F | 21.7 | 22.8 | 1.0 |

TABLE 2

| Plumb 28oz 1pc Framer SS28RCF | | | |
|---|---|---|---|
| Section | Claw Width "A" (mm) | Max Thickness (in defined area) "B" | Ratio A/B |
| A-A | 22.6 | 22.6 | 1.0 |
| B-B | 23.2 | 24.0 | 1.0 |
| C-C | 23.1 | 25.3 | 0.9 |
| D-D | 23.2 | 26.3 | 0.9 |
| E-E | 24.5 | 26.5 | 0.9 |
| F-F | 26.0 | 27.5 | 0.9 |

TABLE 3

FIG. 46

| Stanley FatMax 15oz Framer | | | |
|---|---|---|---|
| Distance from Poll Center Line (mm) | Shaft Width (mm) | Shaft Thickness (mm) | Ratio Width/Thickness |
| 20 | 32.7 | 5.1 | 6.4 |
| 40 | 31.0 | 5.1 | 6.1 |

TABLE 4

| Estwing 22oz 1pc Framer E3-22S | | | |
|---|---|---|---|
| Distance from Poll Center Line (mm) | Shaft Width (mm) | Shaft Thickness (mm) | Ratio Width/Thickness |
| 20 | 24.1 | 18.3 | 1.3 |
| 40 | 22.2 | 10.0 | 2.2 |

TABLE 5

| Plumb 28oz 1pc Framer SS28RCF | | | |
|---|---|---|---|
| Distance from Poll Center Line (mm) | Shaft Width (mm) | Shaft Thickness (mm) | Ratio Width/Thickness |
| 20 | 30.2 | 22.1 | 1.4 |
| 40 | 20.2 | 9.2 | 2.2 |

TABLE 6

| Dead On Steel Framer | | | |
|---|---|---|---|
| Distance from Poll Center Line (mm) | Shaft Width (mm) | Shaft Thickness (mm) | Ratio Width/Thickness |
| 20 | 54.0 | 23.0 | 2.3 |
| 40 | 31.0 | 11.4 | 2.7 |

TABLE 7

FIG. 47

| 1pc Steel Framing and Nailing Hammers | | | | | | | | | | | | |
|---|---|---|---|---|---|---|---|---|---|---|---|---|
| Manufacturer | Model | Description | Overall Length - OAL (in) | Overall Mass (oz) | Head Weight (oz) Measured From Lower Tangent Point of Bell OD | Shaft Weight (oz) | Head/Shaft Weight (oz) | Overall Mass/Head Weight (oz) | Overall Mass/Shaft Weight (oz) | Head Weight/OAL | Shaft Weight/OAL | Overall Mass/OAL |
| Estwing | E3-16S | 16oz rip claw nailer | 13.0 | 27.76 | 15.06 | 12.70 | 1.19 | 1.84 | 2.19 | 1.16 | 0.98 | 2.14 |
| Estwing | E3-20S | 20oz rip claw nailer | 13.6 | 29.90 | 16.74 | 13.16 | 1.27 | 1.79 | 2.27 | 1.23 | 0.97 | 2.19 |
| Estwing | E3-22S | 22oz framer w/smooth face | 15.8 | 33.40 | 18.22 | 15.18 | 1.20 | 1.83 | 2.20 | 1.16 | 0.96 | 2.12 |
| Estwing | E3-25SM | 25oz framer w/checker face | 18.0 | 40.04 | 22.04 | 18.00 | 1.22 | 1.82 | 2.22 | 1.22 | 1.00 | 2.22 |
| Estwing | E3-28S | 28oz framer w/smooth face | 16.0 | 37.78 | 22.68 | 15.10 | 1.50 | 1.67 | 2.50 | 1.42 | 0.94 | 2.36 |
| Vaughan | RCF2 | 19oz framer w/checker face | 16.0 | 36.06 | 18.62 | 17.44 | 1.07 | 1.94 | 2.07 | 1.16 | 1.09 | 2.25 |
| Vaughan | R999ML | 22oz framer w/checker face | 16.0 | 36.48 | 18.88 | 17.60 | 1.07 | 1.93 | 2.07 | 1.18 | 1.10 | 2.28 |
| Plumb | SS28RCF | 28oz framer w/checker face | 16.0 | 36.48 | 22.60 | 13.88 | 1.63 | 1.61 | 2.63 | 1.41 | 0.87 | 2.28 |
| Dead On | DOS22M | 22oz framer w/checker face | 18.0 | 42.94 | 21.90 | 21.04 | 1.04 | 1.96 | 2.04 | 1.22 | 1.17 | 2.39 |
| DeWALT | DWHT51138 | 15oz framer w/checker face | 16.0 | 30.28 | 15.08 | 15.20 | 0.99 | 2.01 | 1.99 | 0.94 | 0.95 | 1.89 |
| DeWALT | DWHT51135 | 14oz rip claw nailer | 14.0 | 27.20 | 13.50 | 13.70 | 0.99 | 2.01 | 1.99 | 0.96 | 0.98 | 1.94 |

TABLE 8

FIG. 49

WELDED HAMMER

CROSS-REFERENCE TO RELATED APPLICATIONS

This application is a continuation of U.S. patent application Ser. No. 13/316,325, titled "WELDED HAMMER," filed Dec. 9, 2011, and claims priority and benefit under 35 U.S.C. §119(e) to U.S. Provisional Patent Application No. 61/562,873, filed Nov. 22, 2011. The entire contents of both priority applications are hereby incorporated herein by reference in their entirety.

BACKGROUND

Field

The present invention relates to hammers. Conventional hammers typically include a head and a handle. During use, a strike surface disposed on the head of the hammer is configured to strike against an object, such as a nail or chisel. The present invention provides various advantages over prior art hammers. For example, in some embodiments the hammer provides an improved weight distribution to provide equivalent or better striking force with a hammer that feels lighter in weight to the user, and in some aspects facilitates a faster hammer swing. In other aspects, the hammer provides an enlarged striking surface. In other aspects, the hammer is cost-effective to manufacture. In other aspects, the hammer provides unique dimensional and weight ratios that provide one or more of ergonomic, weight distribution, and/or aerodynamic attributes.

SUMMARY

One aspect of the present invention provides a hammer that includes a handle and a head. The handle includes a bottom end and an upper end. The head is disposed on the upper end of the handle. The handle and the head are separately formed structures. The handle is formed from sheet metal.

Another aspect of the present invention provides a hammer that includes a handle and a head. The handle has a bottom end and an upper end. The head is disposed on the upper end of the handle and the head has a bell portion and a claw portion. The head of the hammer has a width measurement and the handle of the hammer has a maximum thickness measurement. The width measurement and the maximum thickness measurement are measured at a section that is positioned at portions of the hammer where the head adjoins the handle. A ratio of the width measurement of the head to the maximum thickness measurement of the handle is at least 2.0.

Yet another aspect of the present invention provides a hammer that includes a handle and a head. The handle has a bottom end and an upper end. The head is disposed on the upper end of the handle and the head has a bell portion and a claw portion. The handle of the hammer has a maximum width measurement and a maximum thickness measurement, at one or more measurement sections taken along a measurement axis parallel to a central axis of the bell portion, between 20 mm and 40 mm below the central axis of the bell portion. A ratio of the maximum width measurement to the maximum thickness measurement of the handle is at least 3.5.

Yet another aspect of the present invention provides a hammer that includes a handle and a head. The handle has a bottom end and an upper end. The head is disposed on the upper end of the handle and the head has a bell portion and a claw portion. The hammer having an overall length dimension and an overall mass measurement. A ratio of the overall length dimension of the hammer measured in inches to the overall mass measurement of the hammer measured in ounces is less than 2.10.

Yet another aspect of the present invention provides a hammer that includes a handle and a head. The handle has a bottom end and an upper end. The head is disposed on the upper end of the handle and the head has a bell portion and a claw portion. The hammer having an overall length dimension and the head of the hammer having a weight measurement. A ratio of the weight measurement of the head of the hammer measured in ounces to the overall length dimension of the hammer measured in inches is less than 1.10.

Yet another aspect of the present invention provides a hammer that includes a handle and a head. The handle has a bottom end and an upper end. The head is disposed on the upper end of the handle and the head has a bell portion and a claw portion. The hammer having an overall weight measurement and the head of the hammer having a weight measurement. A ratio of the overall weight measurement of the hammer measured in ounces to the weight measurement of the head of the hammer measured in ounces is at least 1.98.

Yet another aspect of the present invention provides a hammer that includes a handle and a head. The handle has a bottom end and an upper end. The head is disposed on the upper end of the handle and the head has a bell portion and a claw portion. The hammer having an overall weight measurement and the head of the hammer having a weight measurement. A ratio of the overall weight measurement of the hammer measured in ounces to the weight measurement of the handle of the hammer measured in ounces is less than 2.02.

These and other aspects of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein are drawn to scale. It is to be expressly understood, however, that the drawings are for the purpose of illustration and description only and are not intended as a definition of the limits of the invention. It shall also be appreciated that the features of one embodiment disclosed herein can be used in other embodiments disclosed herein. As used in the specification and in the claims, the singular form of "a", "an", and "the" include plural referents unless the context clearly dictates otherwise.

BRIEF DESCRIPTION OF THE DRAWINGS

FIG. 46 shows TABLES 1-3, TABLE 1 provides measurement data (e.g., width measurement of the head and thickness measurement of the handle) measured at sections that are positioned at portions of the hammer where the claw portion adjoins the handle in accordance with the present invention, while TABLES 2 and 3 provide the same measurement data for various hammers across a sampling of multiple brands and/or models;

FIG. 47 shows TABLES 4-7, TABLE 4 provides measurement data (e.g., width measurement and thickness measurement of the handle) measured at a predetermined measurement sections of the hammer in accordance with the present invention, while TABLES 5-7 provide the same measurement data for various hammers across a sampling of multiple brands and/or models;

FIG. 49 shows a TABLE 8 providing a comparison and overview of embodiments of the hammers in accordance with the present invention in comparison with various hammers across a sampling of multiple brands and/or models;

DETAILED DESCRIPTION OF THE INVENTION

Figure 1:
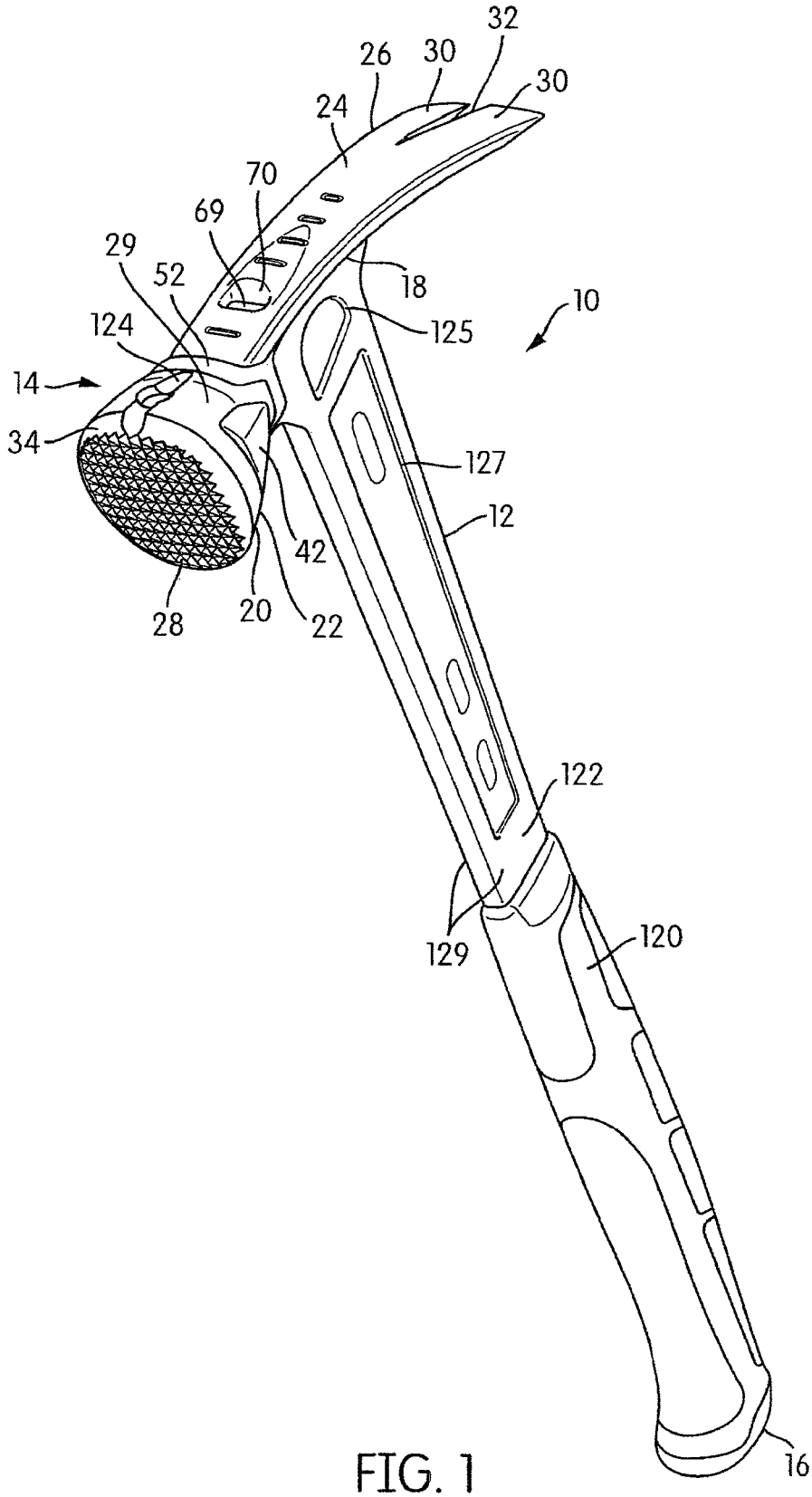
FIG. 1 is a perspective view of a hammer in accordance with an embodiment of the present invention.
Figure 2:
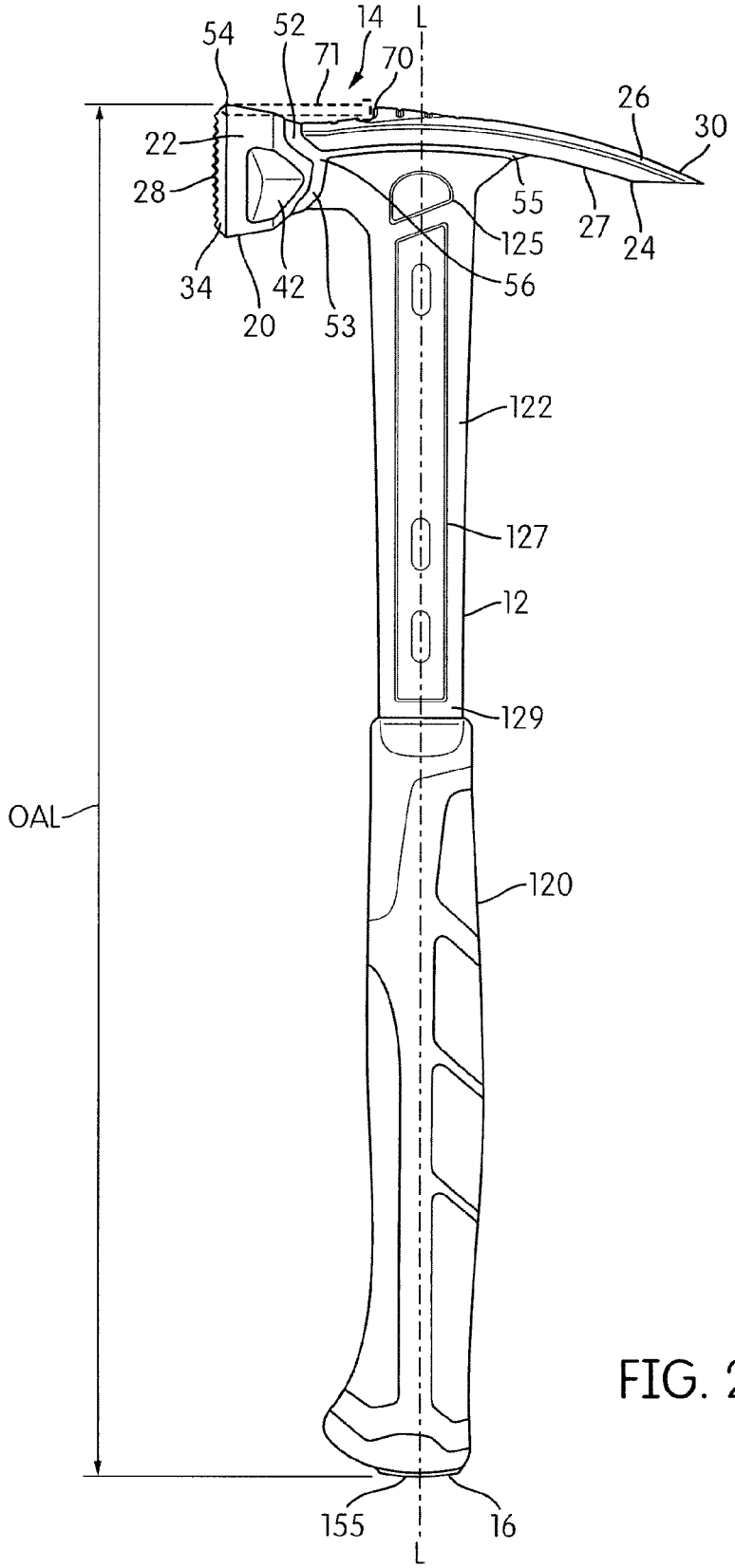
FIG. 2 is a front view of the hammer in accordance with an embodiment of the present invention.
Figure 3:
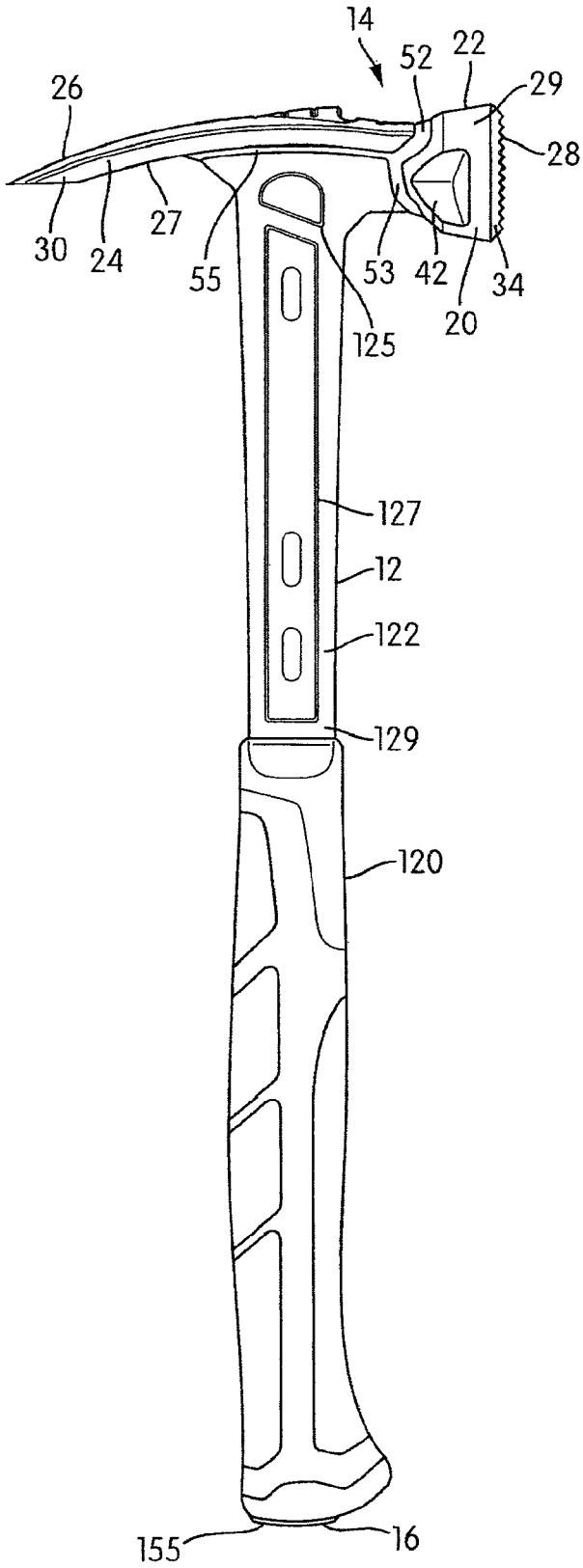
FIG. 3 is a rear view of the hammer in accordance with an embodiment of the present invention.
Figure 4:
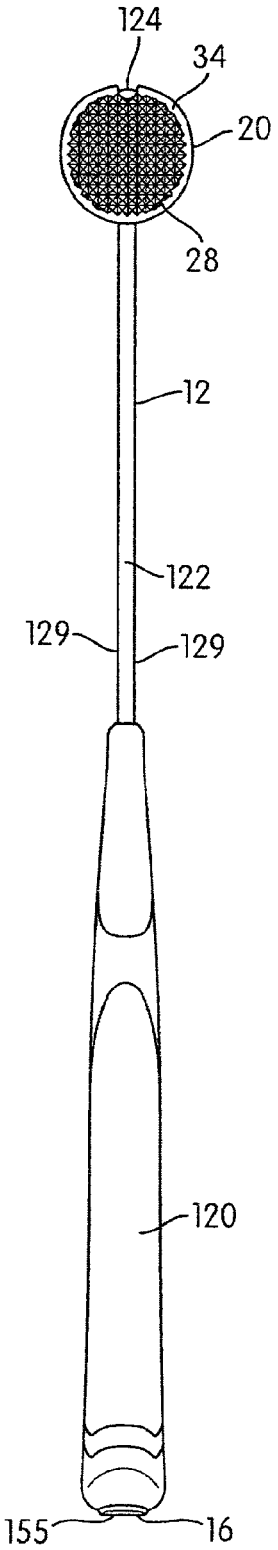
FIG. 4 is a left hand side elevational view of the hammer in accordance with an embodiment of the present invention.
Figure 5:
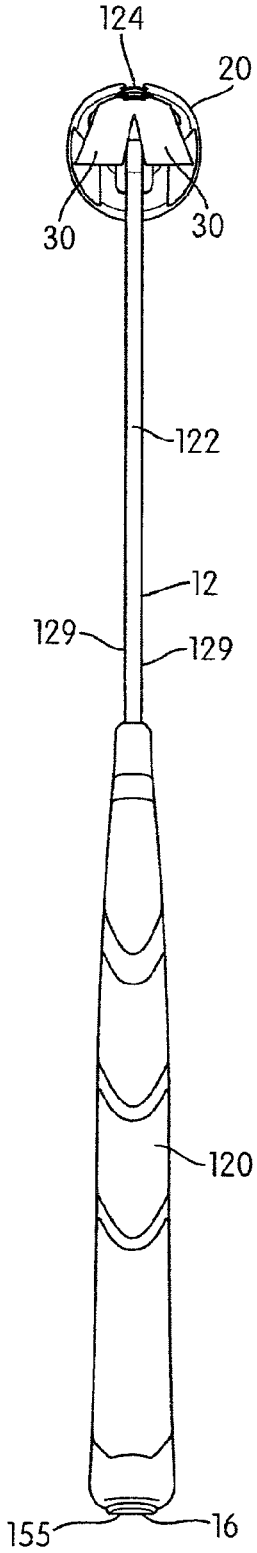
FIG. 5 is a right hand side elevational view of the hammer in accordance with an embodiment of the present invention.
Figure 6:
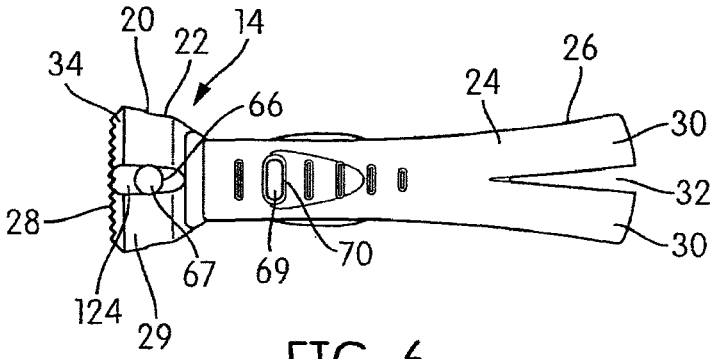
FIG. 6 is a top view of the hammer in accordance with an embodiment of the present invention.
Figure 7:
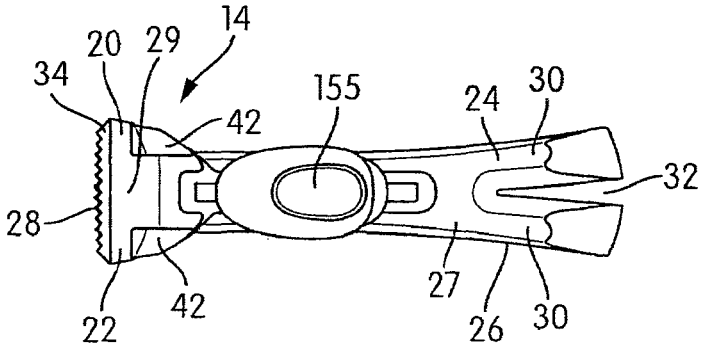
FIG. 7 is a bottom view of the hammer in accordance with an embodiment of the present invention.
Figure 45:
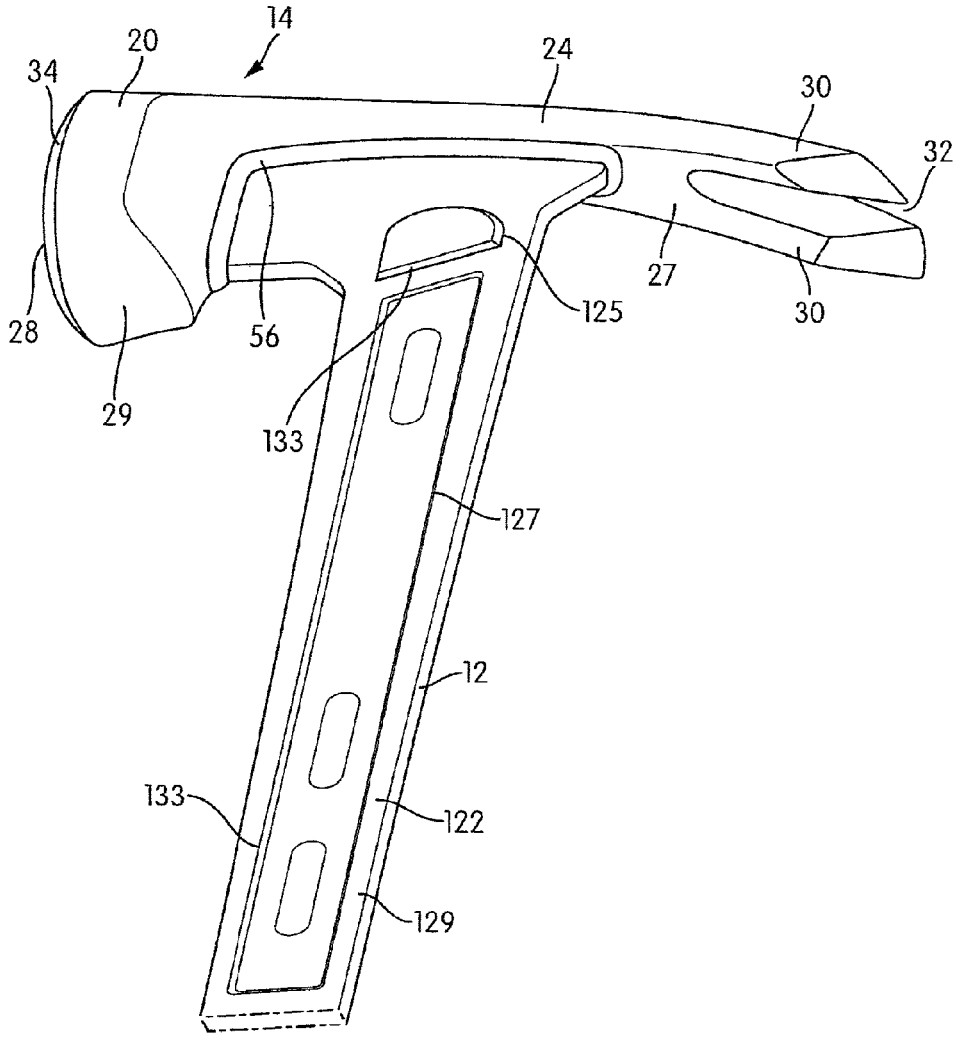
FIG. 45 is another perspective view of the hammer, with grip portions of the handle removed for sake of clarity, in accordance with another embodiment of the present invention.

FIGS. 1-7 show a hammer 10 in accordance with an embodiment of the present invention. The hammer 10 includes a handle 12 and a head 14. The handle 12 includes a bottom end 16 and an upper end 18. The head 14 is disposed on the upper end 18 of the handle 12. The head 14 and the handle 12 are separately formed structures. A weld connection 56 (as shown in FIGS. 2 and 45) connects the head 14 with the handle 12.

In one embodiment, the handle 12 is formed from sheet metal having a thickness of less than 8 mm. In another embodiment, the handle 12 is formed from sheet metal having a thickness between 4 and 6 mm. In yet another embodiment, the handle 12 is formed from sheet metal having a thickness between 4.5 and 5.5 mm.

FIGS. 1-7 show views of the illustrative hammer 10 in its assembled condition. In one embodiment, the head 14 includes a bell portion 20 at one end 22 and a claw portion 24 at the other end 26 thereof.

As shown in FIG. 2, the hammer 10 includes an overall length dimension OAL. In one embodiment, as shown in FIG. 2, the overall length dimension OAL of the hammer 10 is measured along (or relative to) the central longitudinal axis L-L of the hammer 10. The overall length dimension OAL is measured from the bottom-most end surface 16 of the handle 12 to a top most end 54 of the head 14, taken along axis L-L as shown. In the illustrated embodiment, the top-most axial point of the head 14 is disposed at a top surface of the bell portion 20.

In one embodiment, as shown in FIGS. 1-7, the handle 12, the bell portion 20 and the claw portion 24 are separately formed structures. A weld connection 52 connects the bell portion 20 with the claw portion 24, a weld connection 53 connects the bell portion 20 with the handle 12, and a weld connection 55 connects the claw portion 24 with the handle 12. The method of securing these separately formed structures to each other is described in detail below.

Figure 43:
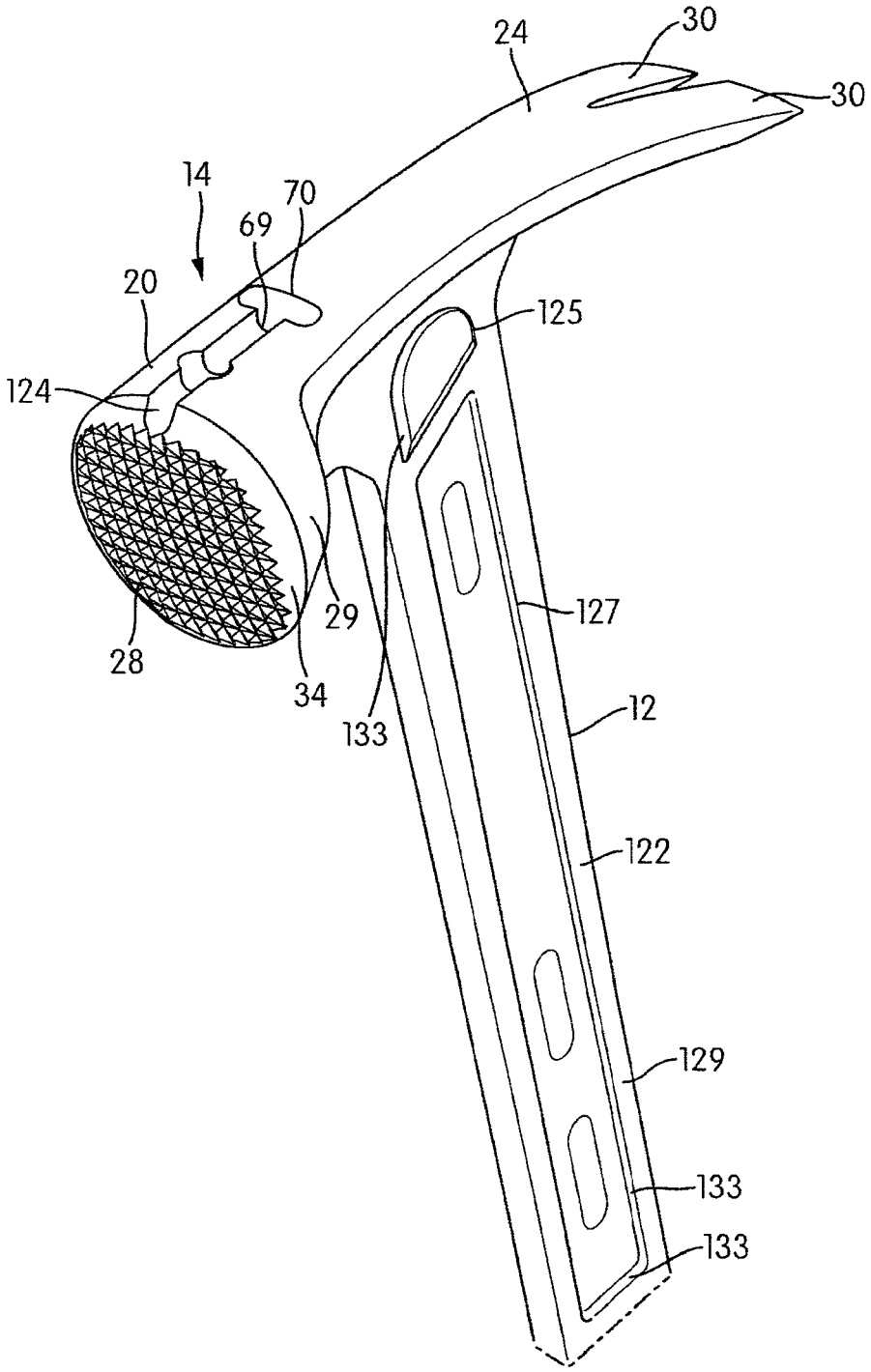
FIG. 43 is a perspective view of a hammer, with grip portions of the handle removed for sake of clarity, in accordance with another embodiment of the present invention.
Figure 44:
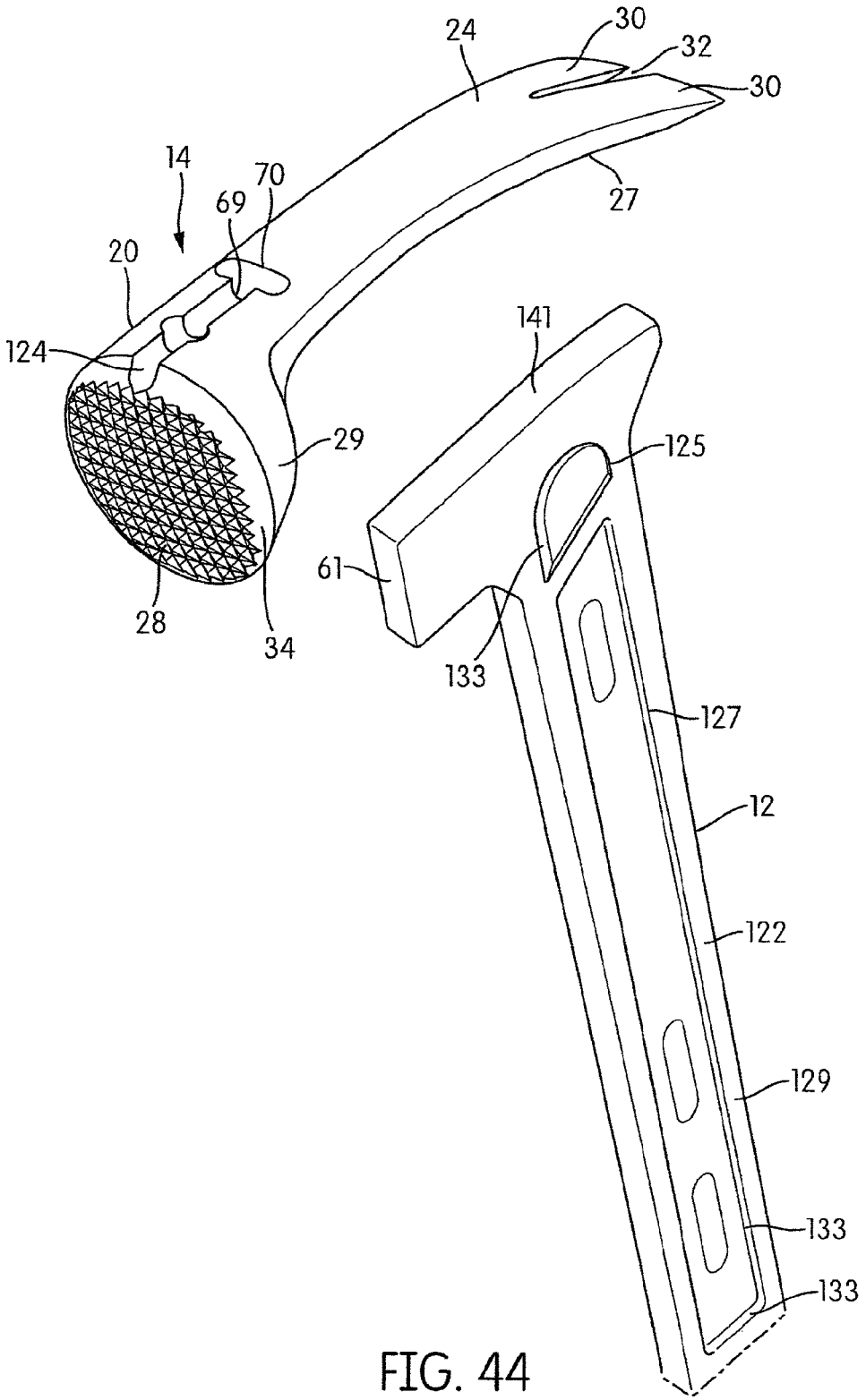
FIG. 44 is an exploded view of the hammer, with grip portions of the handle removed for sake of clarity, in accordance with another embodiment of the present invention.

In another embodiment, as shown and explained with respect to FIGS. 43-45, the bell portion 20 and the claw portion 24 are one-piece integral structures. In such an embodiment, the integrally formed bell portion 20 and claw portion 24 are joined with the separately formed handle 12. For example, the weld connection 56 (as shown in FIG. 45) connects the integrally formed bell portion 20 with claw portion 24 and the handle 12.

In one embodiment, the handle 12 is formed chromium molybdenum (chromoly) steel. For example, the handle 12 may be formed 4130 chromoly steel or 4135 chromoly steel. In one embodiment, the handle 12 is made from chromium-molybdenum steel of a different grade than that that of the bell portion 20 or of the claw portion 24.

In one embodiment, the handle or shaft 12 is made from steel having a lower carbon content than that used for the claw portion 24 or the bell portion 20. When the hammer 10 undergoes a heat treatment process, the low carbon steel material provides the handle 12 with a lower hardness, which in turn provides a vibration dampening for the hammer 10.

In one embodiment, the handle 12 is made of a composite material. In another embodiment, the handle 12 of the hammer 10 is made from stamped sheet metal. In other embodiments, the handle 12 is formed from a carbon steel material. For example, the handle 12 may be formed AISI 1060 steel. In one embodiment, the handle 12 is made from aluminum material.

In one embodiment, the handle 12 is formed by stamping. In another embodiment, the handle 12 is formed by laser cutting or water jet cutting. In other embodiments, the handle 12 is formed by fine blanking, plasma cutting, electrochemical machining, electrical discharge machining, cold forging, hot forging, milling, die cutting, computer numeric controlled machining operation, or any other suitable machining or manufacturing process. In yet other embodiments, the handle 12 may be rolled or extruded.

As shown in FIGS. 1-5, the hammer 10 includes a manually engageable grip portion 120. In one embodiment, the manually engageable grip portion 120 of the hammer 10 is molded onto an inner or core portion 122 of the handle 12. In one embodiment, the grip portion 120 of the handle 12 is made of an elastomeric material, a rubber based material, a plastic based material or other suitable material. Optionally, the grip portion 120 can be ergonomically shaped. In another embodiment, the grip portion 120 is simply the outer surface of the handle material (e.g., metal).

In one embodiment, a surface texture or pattern (e.g., ribbed) may be provided on the grip portion 120. The surface texture or pattern is constructed and arranged to improve the grip of the user. The surface texture or pattern may be provided by knurling, sand blasting, rubber coating, or any other surface texturing methods known in the art. In one embodiment, the grip portion 120 may include a slip-resistant surface that is constructed and arranged to be used in all weather conditions. In one embodiment, the grip portion 120 may include a cushioned grip.

In one embodiment, the manually engageable grip portion 120 (e.g., made from a plastic based material) may be partially or entirely over-molded onto the inner or core portion 122 of the handle 12 to mimic the appearance of the two-piece hammer, for example. The over-molded plastic portion may serve as a protective covering for environments where metal to metal contact may damage portion of the hammer that is being struck. For example, the hammer with the over-molded plastic portion may provide different functions, such as spark resistance, overstrike protection, or simply provide an aesthetic appearance. In one embodiment, a surface 155 (near the lower end 16 of the hammer) of the manually engageable grip portion 120 may have indicia (not shown) such as instructions for using the hammer 10.

In one embodiment, the manually engageable grip portion 120 is formed from one or two layers of resilient material that may be configured to reduce vibration and provide torsion control.

In one embodiment, the hammer 10 may optionally include an over-strike protector structure constructed and arranged to surround a portion of the handle 12 adjacent to (beneath) the upper end 18 of the handle 12. The over-strike protector structure is constructed and arranged to protect the handle 12 and/or reduce vibration imparted to the user's hand during an overstrike (i.e., when a strike surface 28 of the hammer 10 misses an intended object, such as nail or a chisel, and the handle 12 strikes the wood or other surface). In one embodiment, the over-strike protector structure includes an additional or extra layer or mass of resilient material (such as an elastomer or rubber based material) molded on the portion of the handle 12 to dissipate impact energy and stress due to an overstrike. In one embodiment, the over-strike protector structure is constructed and arranged to provide a high degree of cushioning to protect the user's hand from the kinetic energy transferred thereto during impact of the striking surface against the object, such as a nail or a chisel.

Figure 8:
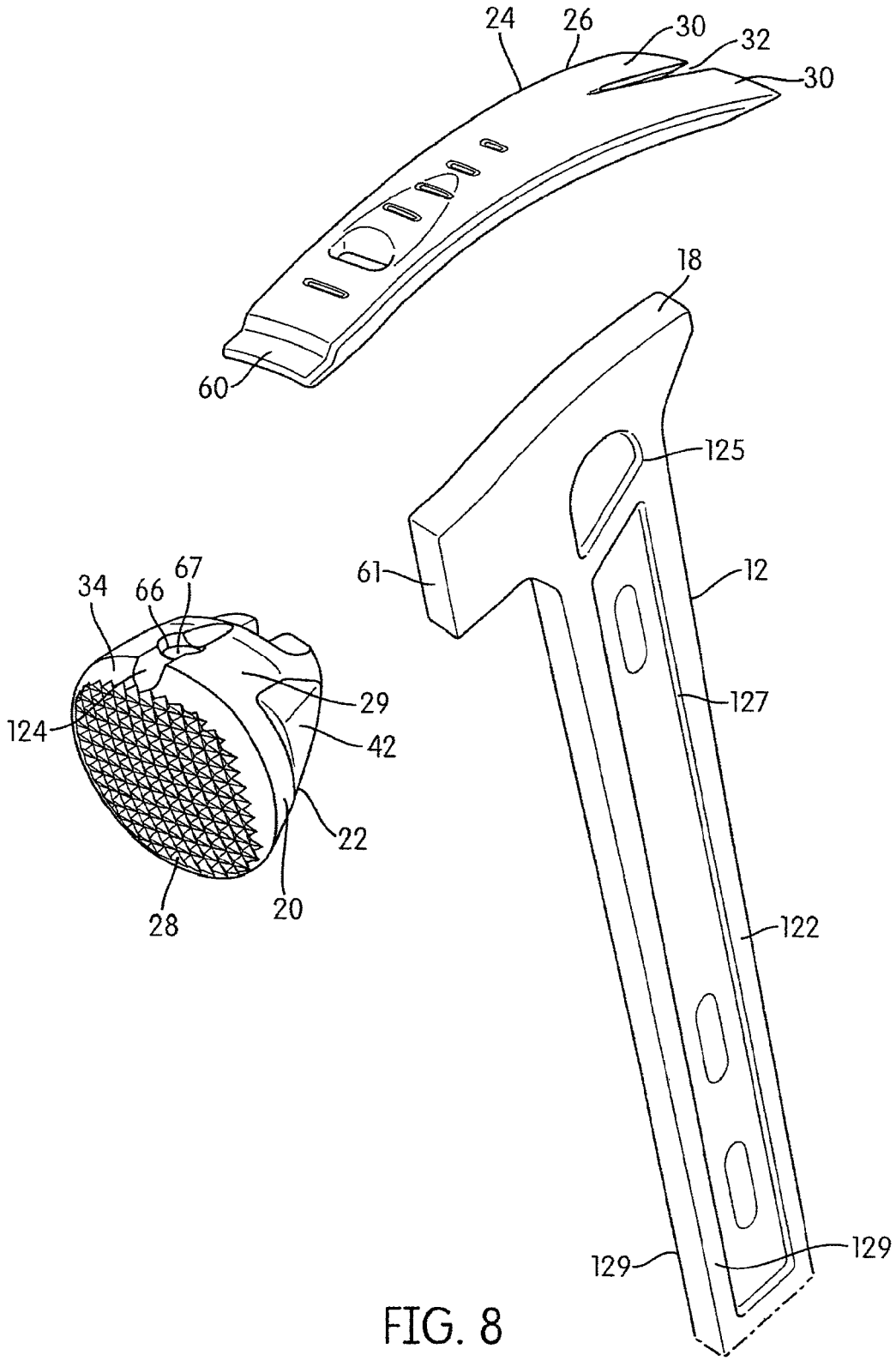
FIG. 8 is an exploded view of the hammer, with grip portions of the handle removed for sake of clarity, in accordance with an embodiment of the present invention.
Figure 9:
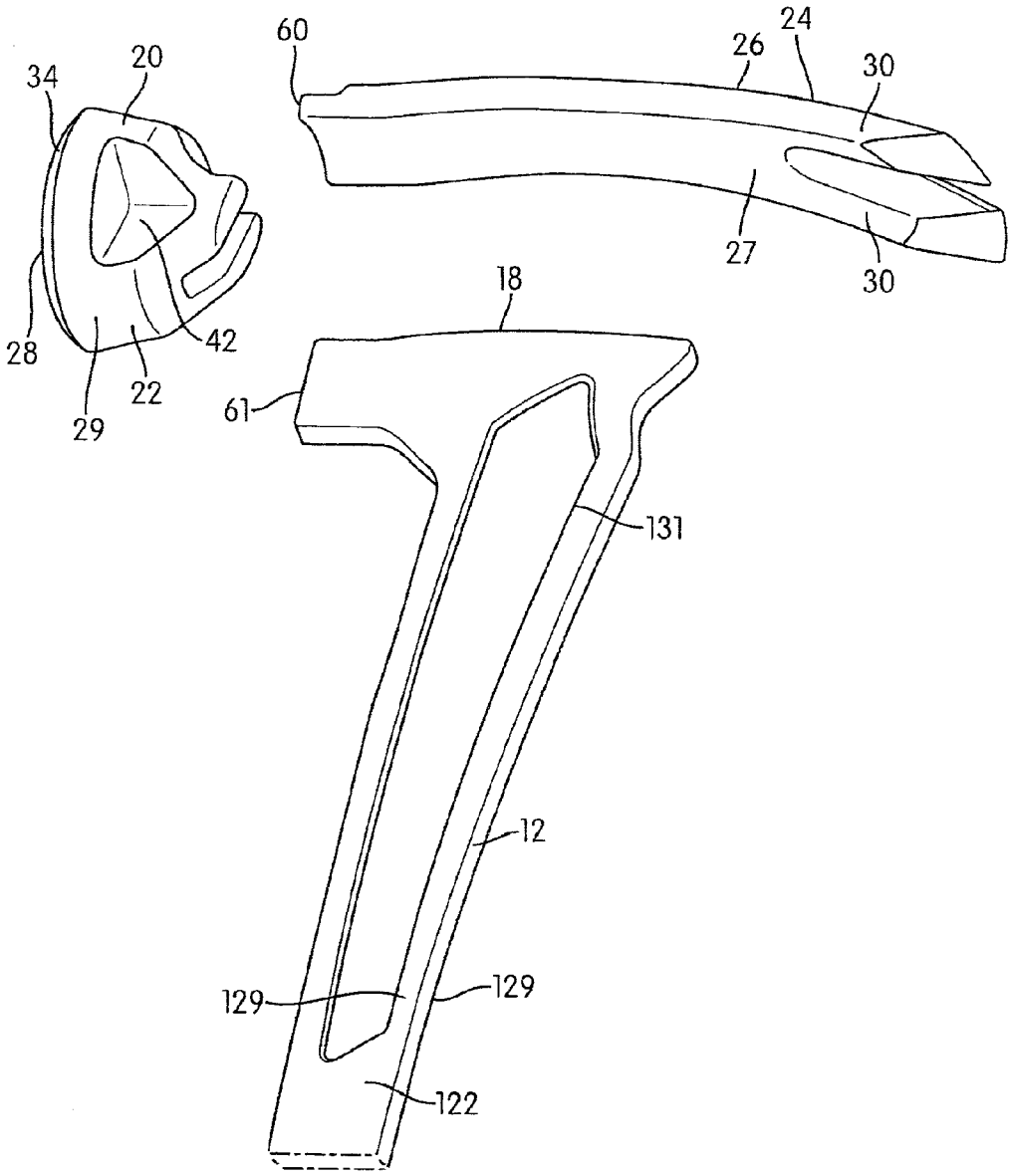
FIG. 9 is another exploded view of the hammer, with grip portions of the handle removed for sake of clarity, in accordance with an embodiment of the present invention.
Figure 10:
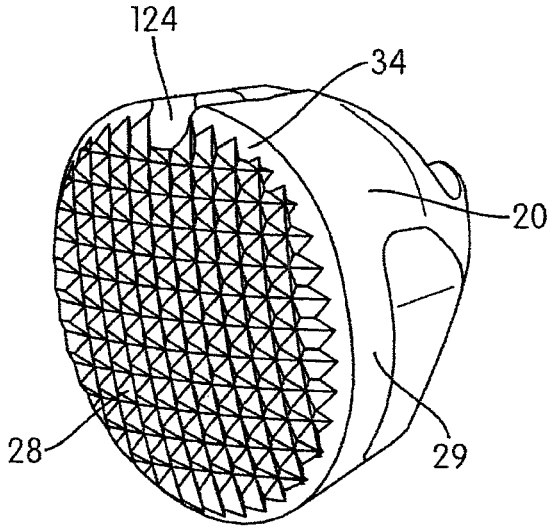
FIG. 10 is a side perspective view of a bell portion of the hammer in accordance with an embodiment of the present invention.

FIGS. 8 and 9 show exploded views of the hammer 10, with the grip portion 120 removed for sake of clarity, in accordance with an embodiment of the present invention. FIGS. 8 and 9 show the hammer 10 in which the handle 12, the bell portion 20 and the claw portion 24 are separately formed structures. These separately formed structures are secured to each other, for example, using weld connections. The handle core portions 122 of the hammers shown in FIGS. 8 and 9 are different from each other. These handle core portions 122 of the hammers shown in FIGS. 8 and 9 are explained in further detail with respect FIGS. 22-34

Detail views of the bell portion 20 are shown in FIGS. 10-15. FIGS. 12-15 show portions and dimensions of various parts of the bell portion in accordance with an embodiment of the present invention. The portions and dimensions of various parts of the bell portion shown in FIGS. 12-15 are intended to be merely exemplary and not limiting in any way. The various parts of the bell portion shown in FIGS. 12-15 are drawn to scale in accordance with one embodiment, although other scales and shapes may be used in other embodiments. The dimensions of various parts of the bell portion as shown in FIGS. 12-15 are measured in millimeters unless indicated otherwise. In one embodiment, the dimensions of various parts of the bell portion, as shown in FIGS. 12-15, are up to 10 percent greater than or up to 10 percent less than those illustrated. In another embodiment, the dimensions of various parts of the bell portion, as shown in FIGS. 12-15, are up to 5 percent greater than or up to 5 percent less than those illustrated.

In one embodiment, the weight of the bell portion 20 is within the range of from approximately 0.178 kilograms to 0.196 kilograms. In one embodiment, the weight of the bell portion 20 is 0.187 kilograms.

In one embodiment, the bell portion 20 is formed chromium molybdenum (chromoly) steel. For example, the bell portion 20 may be formed 4140 chromoly steel. In one embodiment, the bell portion 20 is made from chromoly steel of a different grade than that of the handle 12. In one embodiment, the bell portion 20 is made from substantially same grade of chromoly steel as the claw portion 24. Chromoly steel is used to provide structural strength and toughness to the bell portion 20.

In another embodiment, the bell portion 20 is made from a shock resistant tool steel to withstand impact. In another embodiment, the bell portion 20 is formed from cold formed metal. In other embodiments, the bell portion 20 is formed from a carbon steel material. For example, the bell portion 20 may be formed AISI 1060 steel or AISI 1055 steel.

In one embodiment, the bell portion is formed from cold forging. In other embodiments, the bell portion 20 may be formed by hot forging, cold forming, cold heading, casting, rolling, extrusion, metal injection molding (MIM), or formed from stamped sheet metal.

When the bell portion 20 is made from the metal injection molding (MIM) operation, the bell portion 20 may be made using a powered metal material. The metal injection molding is configured to eliminate the need for secondary forming operations on the bell portion 20. For example, the "waffle" pattern that is generally machined onto a strike surface 28 of the head 14 may be made during the same operation that makes the bell portion 20.

The bell portion 20 located at the forward portion of the head 14 of the hammer 10 includes the strike surface 28. A chamfer or bevel 34 is located circumferentially along the edges of the strike surface 28 of the hammer 10. When the hammer 10 is swung in a swing plane of the hammer, the strike surface 28 strikes an object, such as a nail or a chisel.

In one embodiment, the strike surface 28 of the hammer 10 is slightly convex in order to facilitate square contact during driving of nails. In one embodiment, as can be clearly seen in FIGS. 13 and 14, the strike surface 28 is convex in both horizontal and vertical directions.

In one embodiment, the strike surface 28 may be made larger while keeping the overall weight of the hammer 10 lower (i.e., when compared to traditional hammers made from steel). In one embodiment, a ratio of head weight of the hammer, measured in ounces at 3.0 inches from top of the head, to surface area of the striking surface of the head measured in square inches, is less than 16.25. In another embodiment, a ratio of the head weight of the hammer measured in ounces to the surface area of the striking surface of the head measured in square inches is less than 14.0. A hammer having such a large strike surface configuration is described in detail in a U.S. Pat. No. 8,047,099, filed on May 18, 2009 and issued on Nov. 1, 2011, the entirety of which is hereby incorporated into the present application by reference.

In one embodiment, an additional or extra portion of the hammer's mass may be concentrated in the bell portion 20 or behind the strike surface 28. During use the hammer generally rotates along the handle axis due to the mass of the claw portion, which continues forward after the blow has been delivered. This rotation may cause fatigue to the user since the user must continuously try to counter the rotation of the hammer during the striking by the squeezing the grip harder. The hammer 10 of the present invention is constructed and arranged to counter the rotation of the hammer during the striking of the object by concentrating more of the hammer's mass in the bell portion 20 or behind the strike surface 28.

In one embodiment, the bell portion 20 tapers so as to be reducing in diameter as it extends away from the chamfer 34. In one embodiment, the bell portion 20 is devoid of a cylindrically shaped structure, and wherein the tapered portion 29 of the bell portion 20 adjoins the chamfer 34.

In one embodiment, a plurality of circumferentially spaced recesses 42 are located adjacent to but spaced from the strike surface 28 of the head 14. A relatively large strike surface 28 is provided without substantially increasing the overall weight of the overall hammer 10 or of the head 14 by providing these recesses 42. The material in these plurality of circumferentially spaced recesses 42 is removed in comparison with prior art configurations; the term "removed" as used herein does not require that the material first be provided in such regions and then taken away. Rather the recesses can be formed during the initial machining or manufacturing process of the bell portion, or can be formed after the initial machining or manufacturing process of the bell portion to provide a large strike surface 28 and maintain the overall weight of the hammer 10.

Figure 11:
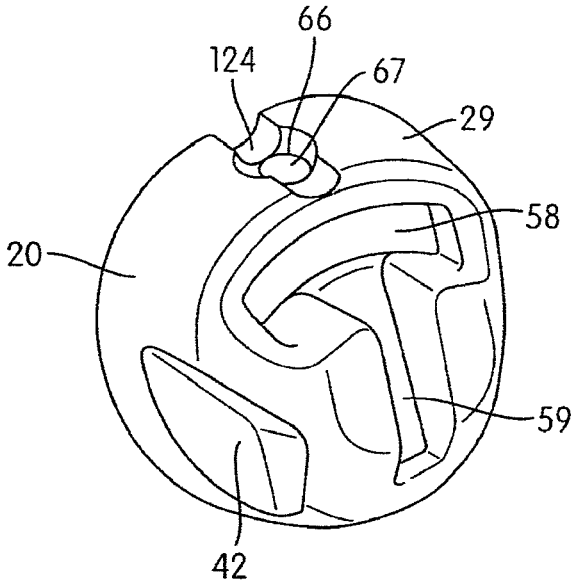
FIG. 11 is another side perspective view of a bell portion of the hammer in accordance with an embodiment of the present invention.
Figure 12:
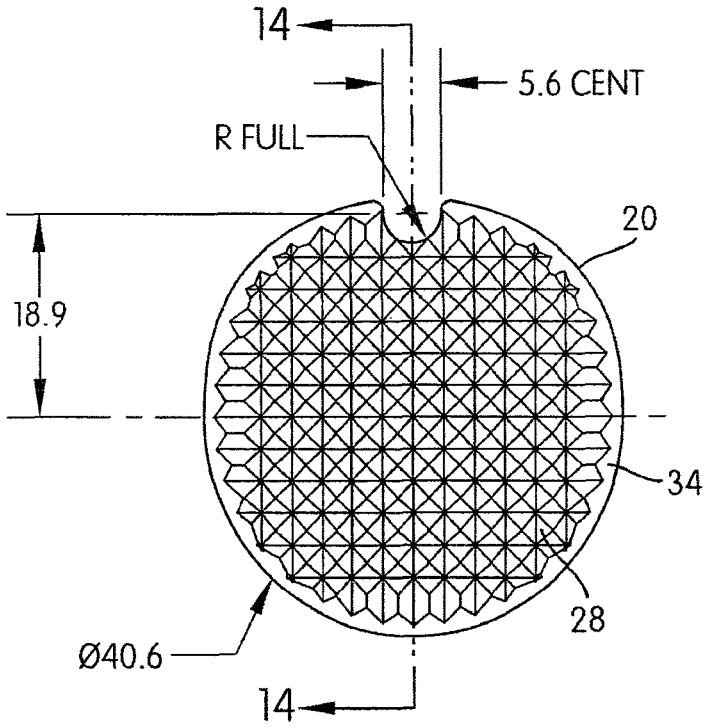
FIG. 12 is a left hand side elevational of the bell portion in accordance with an embodiment of the present invention.
Figure 15:
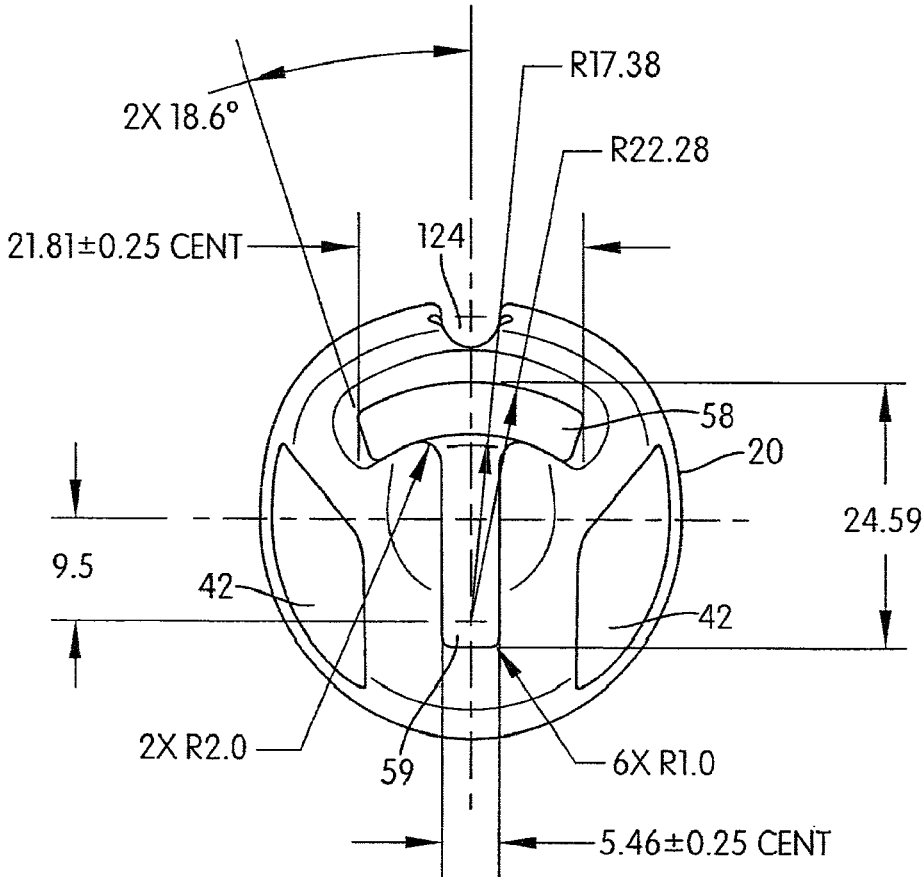
FIG. 15 is a right hand side elevational view of the bell portion in accordance with an embodiment of the present invention.
Figure 16:
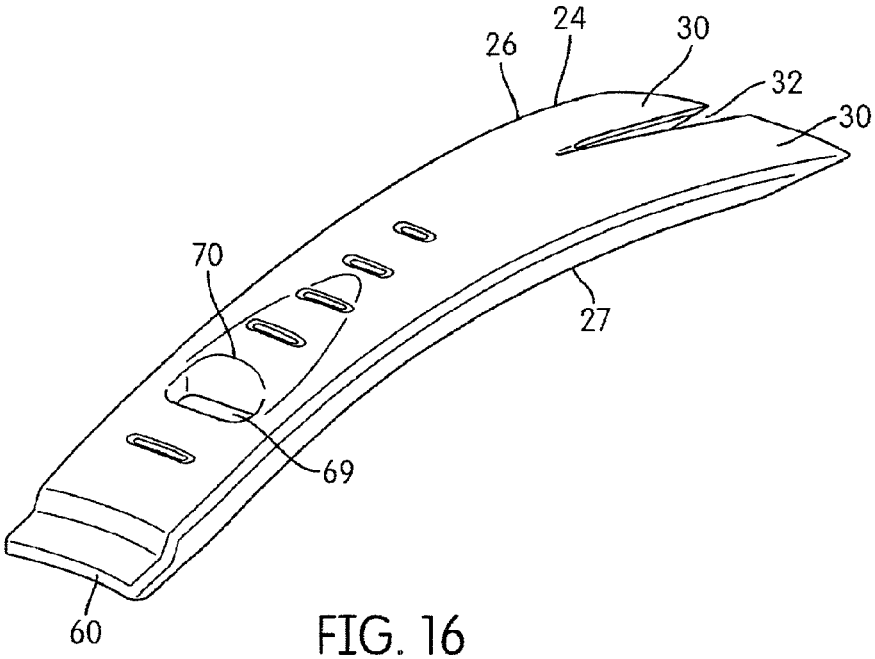
FIG. 16 is a side perspective view of a claw portion of the hammer in accordance with an embodiment of the present invention.
Figure 17:
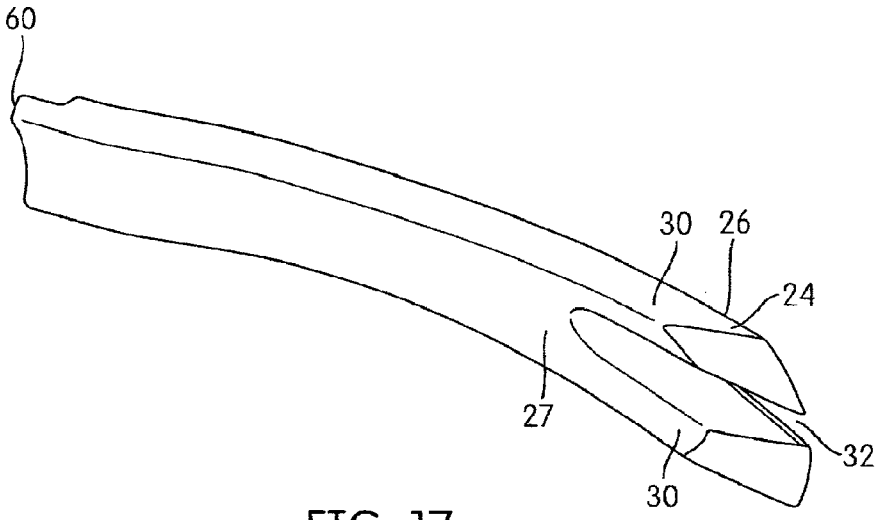
FIG. 17 is another perspective view of a claw portion of the hammer in accordance with an embodiment of the present invention.
Figure 18:
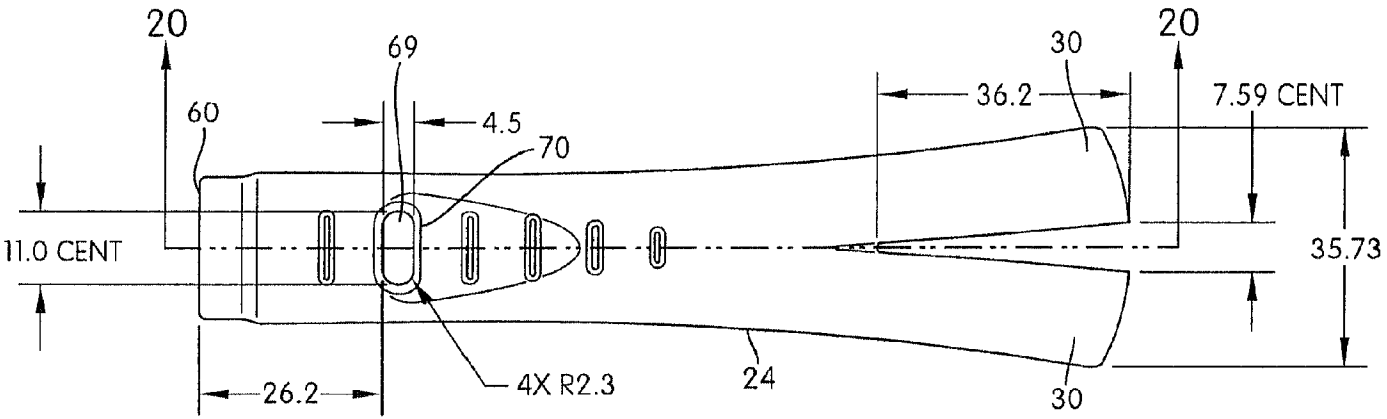
FIG. 18 is a top view of the claw portion in accordance with an embodiment of the present invention.
Figure 19:
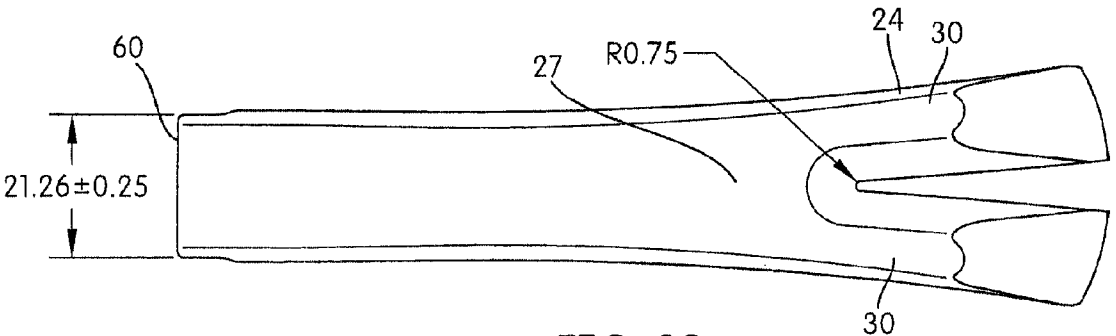
FIG. 19 is a bottom view of the claw portion in accordance with an embodiment of the present invention.
Figure 20:
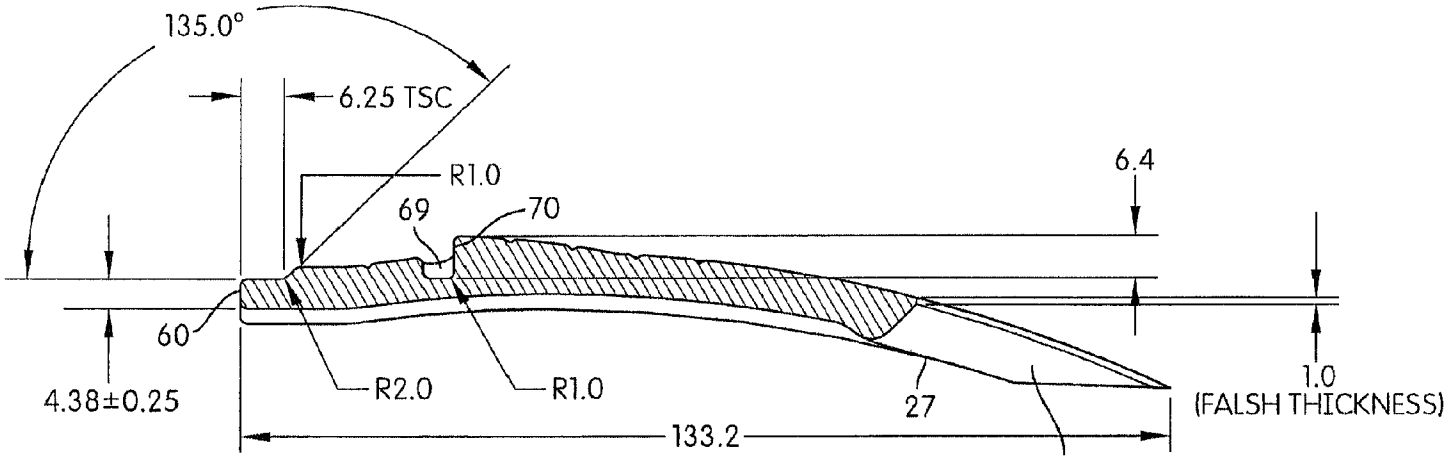
FIG. 20 is a sectional view thereof along the line 20-20 of FIG. 18 in accordance with an embodiment of the present invention.
Figure 21:
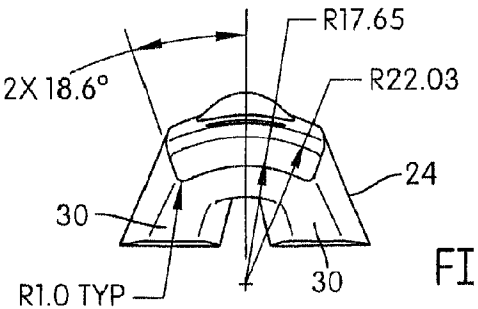
FIG. 21 is a right hand side elevational view of the claw portion in accordance with an embodiment of the present invention.

In one embodiment, the bell portion 20 may include claw portion receiving portion 58 (as shown in FIGS. 11 and 15) that is constructed and arranged to receive a portion 60 (as shown in FIGS. 16-20) of the claw portion 24, when securing the bell portion 20 to the claw portion 24, for example, using a welding operation. In another embodiment, as noted above, the bell portion 20 and the claw portion 24 may be integrally formed as one-piece structures. In such an embodiment, the bell portion 20 may not include the claw portion receiving portion 58.

In one embodiment, the bell portion 20 may include handle receiving portion 59 (as shown in FIGS. 11 and 15) that is constructed and arranged to receive a portion 61 (as shown in FIGS. 22, 23, 29 and 30) of the handle 12, when securing the bell portion 20 to the handle 12, for example, using a welding operation.

In one embodiment, a groove 124 may be located along a top surface of the bell portion 20. The groove 124, if provided, is constructed and arranged to receive and retain a portion of a nail 71 (shown in dashed lines in FIG. 2) therein, when the nail 71 is placed in an initial nail driving position to facilitate the start of a nail driving operation.

Figure 13:
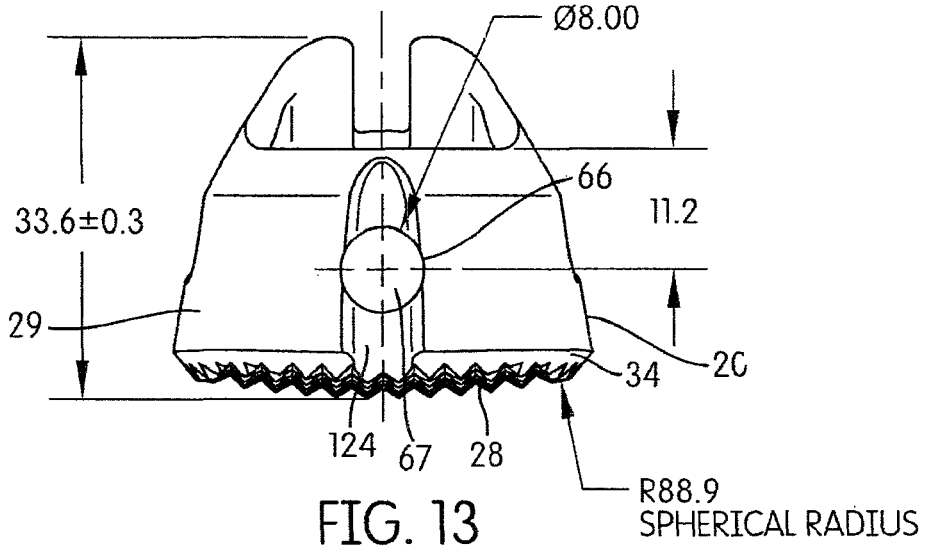
FIG. 13 is a top view of the bell portion in accordance with an embodiment of the present invention.
Figure 14:
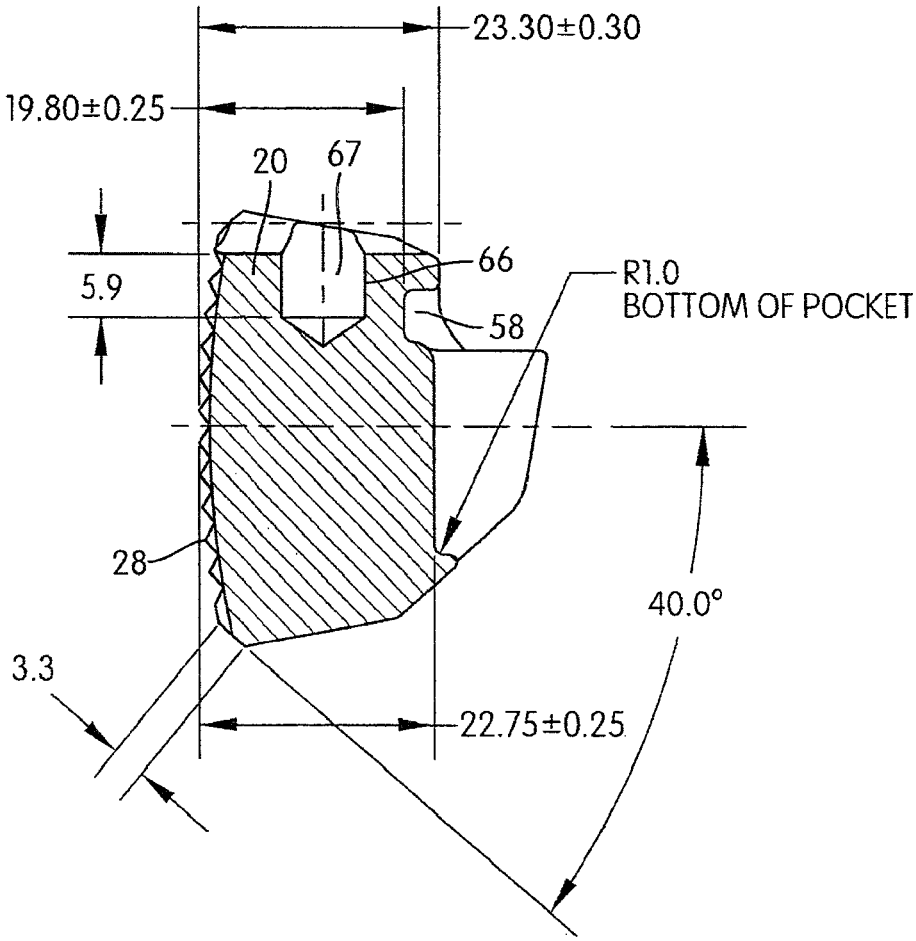
FIG. 14 is a sectional view thereof along the line 14-14 of FIG. 12 in accordance with an embodiment of the present invention.

In one embodiment, as shown in FIGS. 11, 13, and 14, an opening 66 located on the top surface of the bell portion 20 that is configured to receive a magnet 67. The magnet 67 is constructed and arranged to help retain the nail 71 in the initial nail driving position in the groove 124 to facilitate the start of the nail driving operation.

Referring to FIGS. 1 and 2, a notch 70 is disposed on the top surface head 14. As shown in FIG. 2, a surface 69 of the hammer 10 is constructed and arranged to support a head of the nail 71 (shown in dashed lines in FIG. 2). In one embodiment, the notch 70 and the surface 69 are formed on the top surface of the claw portion 24. Thus, the groove 124, the magnet 67, and the surface 69 act together to position and to initially drive the nail 71 in a first blow into a work piece. The nail starter arrangement that includes the groove 124, magnet 67, and the surface 69 is optional.

Detail views of the claw portion 24 are shown in FIGS. 16-21. FIGS. 18-21 show portions and dimensions of various parts of the claw portion in accordance with an embodiment of the present invention. The portions and dimensions of various parts of the claw portion shown in FIGS. 18-21 are intended to be merely exemplary and not limiting in any way. The various parts of the claw portion shown in FIGS. 18-21 are drawn to scale in accordance with one embodiment, although other scales and shapes may be used in other embodiments. The dimensions of various parts of the claw portion as shown in FIGS. 18-21 are measured in millimeters unless indicated otherwise. In one embodiment, the dimensions of various parts of the claw portion, as shown in FIGS. 18-21, are up to 10 percent greater than or up to 10 percent less than those illustrated. In another embodiment, the dimensions of various parts of the claw portion, as shown in FIGS. 18-21, are up to 5 percent greater than or up to 5 percent less than those illustrated.

In one embodiment, the weight of the claw portion 24 is within the range of from approximately 0.134 kilograms to 0.148 kilograms. In one embodiment, the weight of the claw portion 24 is 0.141 kilograms.

In one embodiment, the claw portion 24 is formed chromium molybdenum (chromoly) steel. For example, the claw portion 24 may be formed 4140 chromoly steel. In one embodiment, the claw portion 24 is made from chromoly steel material of a different grade than that of the handle 12. In one embodiment, the claw portion 24 is made from substantially same grade of chromoly steel as the bell portion 20. Chromoly steel is used to provide structural strength and toughness to the claw portion 24.

In another embodiment, the claw portion 24 is made from high carbon spring steel material. The high carbon steel material provides not only high hardness but also high yield strength to the claw portion 24. In one embodiment, the claw portion 24 is formed from stamped sheet metal. In other embodiments, the claw portion 24 is formed from a carbon steel material. For example, the claw portion 24 may be formed AISI 1060 steel or AISI 1055 steel.

In one embodiment, the claw portion 24 is formed from hot forging. In another embodiment, the claw portion 24 is formed from stamping sheet metal or cold forging. In other embodiments, the claw portion 24 may be cold forming, forging, casting, rolling, extrusion, or metal injection molding.

In the illustrated embodiment, as shown in FIGS. 16-19, the claw portion 24 of the head 14 includes a pair of tapered, spaced-apart (forked) nail removing members 30. The nail removing members 30 provide a V-shaped or triangular space 32 therebetween. The shank of a nail can be received in the V-shaped space 32 with the top of the hammer 10 facing the work piece and the nail is removed by engaging the spaced apart claw members 30 with the head of the nail and withdrawing the nail from a work piece.

In some embodiments, a forked claw portion is not provided, but rather a single rearwardly extending portion is provided, as is known in masonry applications. Such single rear portion is not typically considered to be a "claw" in the art, as a single rear portion has a different function and purpose than a nail pulling claw. For convenience and for the purposes of the claims contained in this application, however, the term "claw portion" as used herein should be construed broadly to cover a single rear extension as well as the forked arrangement.

In one embodiment, the claw portion 24 is generally straight to provide a rip or straight claw hammer that is constructed and arranged for use in framing and ripping. In another embodiment, the claw portion 24 is generally curved to provide a curved claw hammer that is constructed and arranged to remove nails.

In one embodiment, the claw portion 24 of the head 14 may include handle receiving opening(s) on a bottom surface 27 thereof that are constructed and arranged to receive a portion of the handle 12, when securing the claw portion 24 to the handle 12, for example, using a welding operation. In another embodiment, the claw portion 24 may not have any such opening(s) on the bottom surface 27. In such an embodiment, the handle 12 is held in place against the bottom surface while it is being welded or secured to the claw portion 24.

In one embodiment, the claw portion 24 may include the portion 60 (as shown in FIGS. 16-20) that is constructed and arranged to be received in the claw portion receiving portion 58 (as shown in FIGS. 11 and 15) of the bell portion 20, when securing the bell portion 20 to the claw portion 24, for example, using a welding operation.

Detail views of the handle, without the grip portion, are shown in FIGS. 22-27 and 29-34. FIGS. 23-27 show portions and dimensions of various parts of handle core portion 122 in accordance with an embodiment of the present invention, while FIGS. 30-34 show portions and dimensions of various parts of the handle core portion 122 in accordance with another embodiment of the present invention.

The portions and dimensions of various parts of the handle core portion 122 shown in FIGS. 22-27 and 29-34 are intended to be merely exemplary and not limiting in any way. The various parts of the handle core portion 122 shown in FIGS. 22-27 and 29-34 are drawn to scale in accordance with one embodiment, although other scales and shapes may be used in other embodiments. The dimensions of various parts of the handle core portion 122 as shown in FIGS. 22-27 and 29-34 are measured in millimeters unless indicated otherwise. In one embodiment, the dimensions of various parts of the handle core portion 122, as shown in FIGS. 22-27 and 29-34, are up to 10 percent greater than or up to 10 percent less than those illustrated. In another embodiment, the dimensions of various parts of the handle core portion 122, as shown in FIGS. 22-27 and 29-34, are up to 5 percent greater than or up to 5 percent less than those illustrated.

In one embodiment, the weight of the handle 12 (without the grip portion 120) or handle core portion 122 is within the range of from approximately 0.32 kilograms to 0.362 kilograms. In one embodiment, the weight of the handle core portion 122 (as shown in FIGS. 22-27) is within the range of from approximately 0.328 kilograms to 0.362 kilograms. In one embodiment, the weight of the handle core portion 122 is 0.345 kilograms. In another embodiment, the weight of the handle core portion 122 (as shown in FIGS. 29-34) is within the range of from approximately 0.32 kilograms to 0.354 kilograms. In one embodiment, the weight of the handle core portion 122 is 0.337 kilograms.

Figure 29:
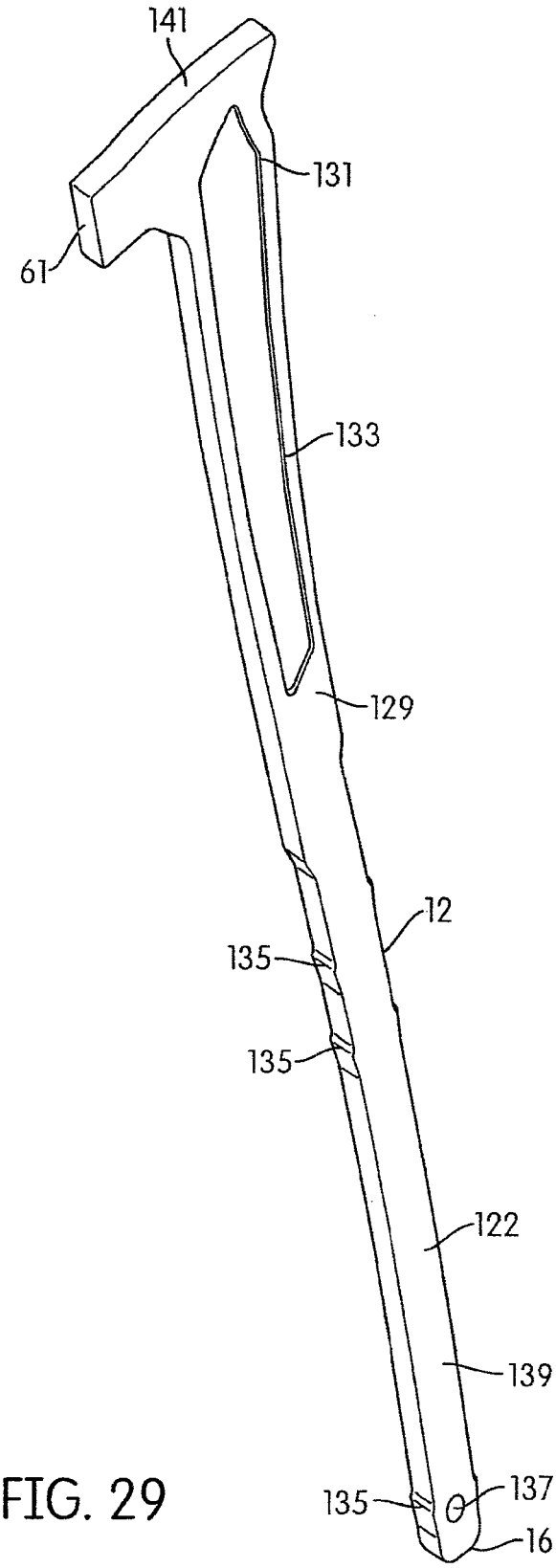
FIG. 29 is a side perspective view of the handle in accordance with another embodiment of the present invention.
Figure 30:
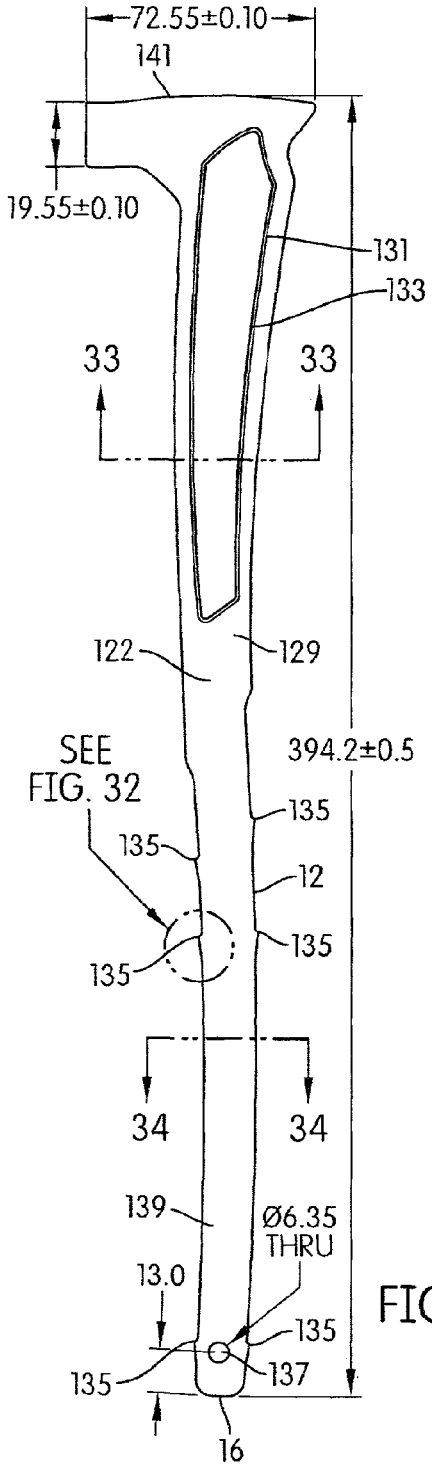
FIG. 30 is a front view of the handle in accordance with another embodiment of the present invention.

As shown in FIGS. 1-3 and 22-23, in one embodiment, the handle core portion 122 may include recess portions 125 or 127 on at least one side surface 129 thereof so as to reduce the overall weight of the hammer 10. In one embodiment, the handle 12 may include recess portion 125 and elongated recess portion 127. In another embodiment, as shown in FIGS. 29 and 30, the handle core portion 122 may include an elongated recess portion 131 on at least one side surface 129 thereof.

In one embodiment, the recess portions 125, 127 or 131 may have advertising or promotional information such as indicia (not shown) for identifying the product and/or manufacturer to the customers. These recess portions 125, 127 or 131 can be formed during the initial machining or manufacturing process of the handle core portion 122, or can be formed after the initial machining or manufacturing process of the handle core portion 122.

The elongated recess portions 127 and 131 are configured to extend for at least a certain length of the handle core portion 122. The handle core portion 122 has a substantially uniform thickness except for the portions where the recess portions 125, 127 or 131 are disposed. That is, the portions of the handle core portion 122 where recess portions are disposed have reduced or decreased thickness than the rest of the handle core portion 122.

Peripheral edge surfaces 133 of the recess portions 125, 127 or 131 facilitate gradually blending or transition of the recess portions 125, 127 or 131 to the surrounding handle portions.

In one embodiment, the handle core portion 122 may include the portion 61 (as shown in FIGS. 22, 23, 29 and 30) that is constructed and arranged to be received in the handle receiving portion 59 (as shown in FIGS. 11 and 15) of the bell portion 20, when securing the bell portion 20 to the handle core portion 122, for example, using a welding operation.

Figure 25:
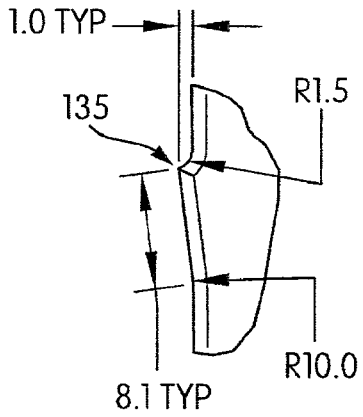
FIG. 25 is detailed view of a projection disposed on the handle in accordance with an embodiment of the present invention.
Figure 32:
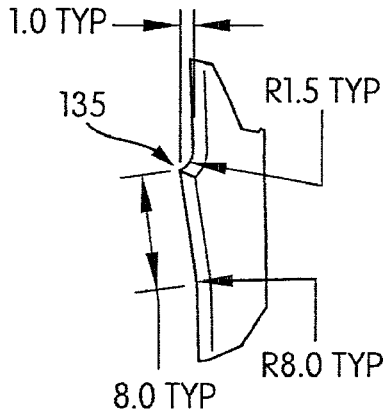
FIG. 32 is detailed view of a projection disposed on the handle in accordance with another embodiment of the present invention.

In one embodiment, as shown in FIGS. 22, 23, 29 and 30, the handle core portion 122 may include a plurality of projections 135 and an opening 137 positioned on a lower half section 139 of the handle core portion 122. In one embodiment, the handle core portion 122 and the grip portion 120 (as shown in FIGS. 1-5) are secured together and are interlocked by the projections 18 extending into the grip portion 120. In one embodiment, the grip portion 120 has a portion disposed in the opening 137 to interlock the grip portion 120 and the handle core portion 122, when the grip portion 120 is being secured to the handle core portion 122. Detailed views of the projections are shown in FIGS. 25 and 32.

In one embodiment, the handle core portion 122 includes a surface 141 that is constructed and arranged to engage with or rest against the surface 27 of the claw portion 24, when securing the claw portion 24 to the handle 12, for example, using a welding operation.

Figure 22:
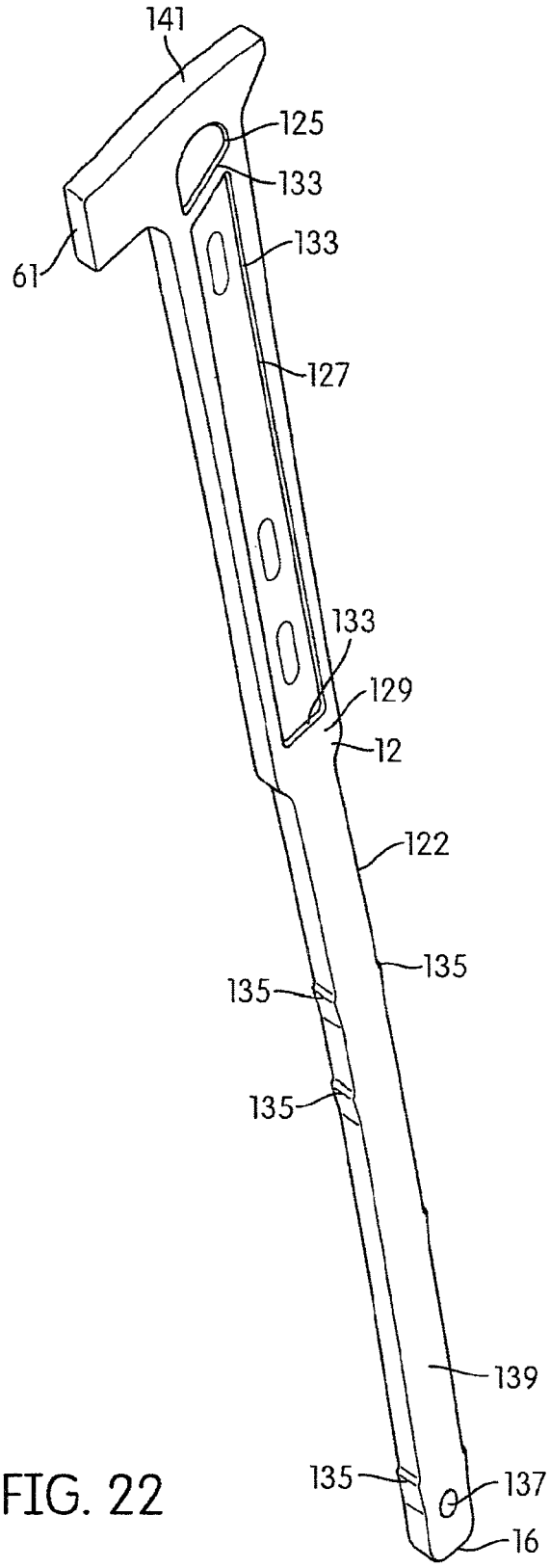
FIG. 22 is a side perspective view of the handle in accordance with an embodiment of the present invention.
Figure 23:
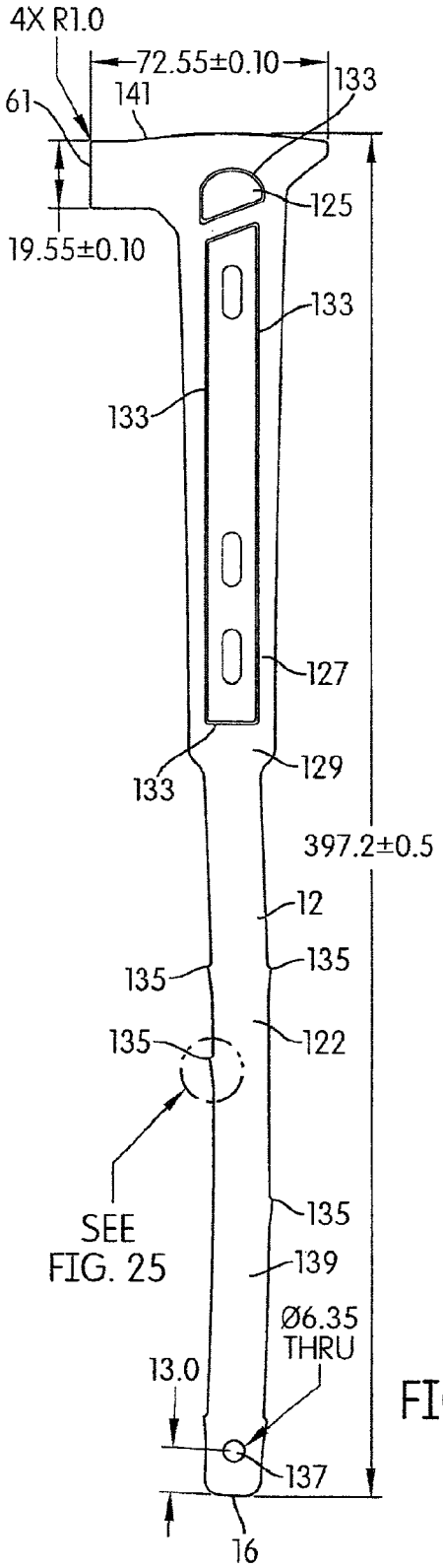
FIG. 23 is a front view of the handle in accordance with an embodiment of the present invention.
Figure 24:
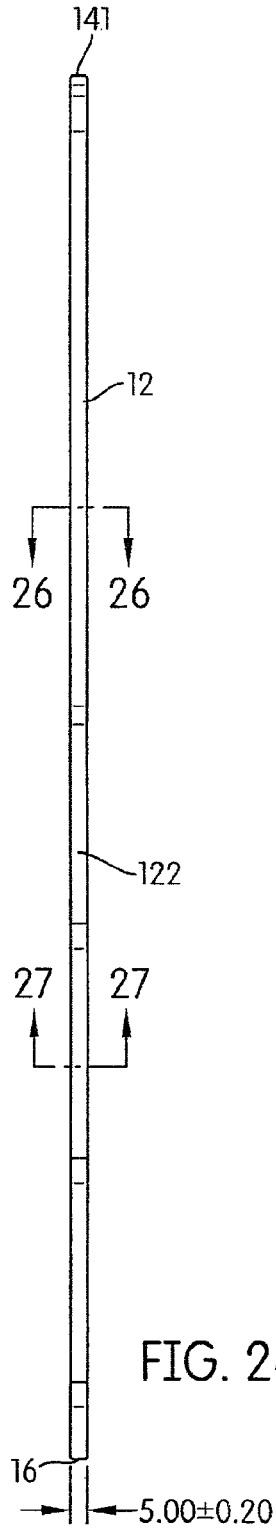
FIG. 24 is a side elevational view of the handle in accordance with an embodiment of the present invention.
Figure 26:
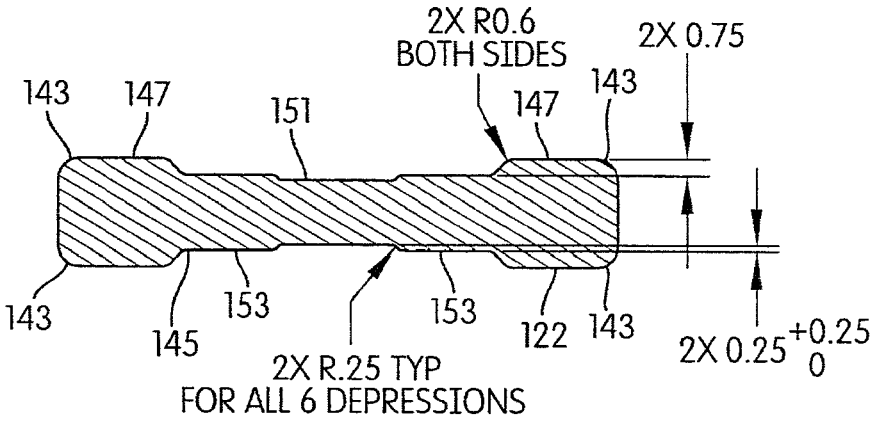
FIG. 26 is a sectional view thereof along the line 26-26 of FIG. 24 in accordance with an embodiment of the present invention.
Figure 27:
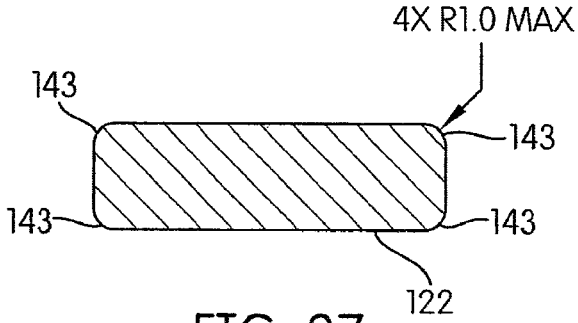
FIG. 27 is a sectional view thereof along the line 27-27 of FIG. 24 in accordance with an embodiment of the present invention.
Figure 31:
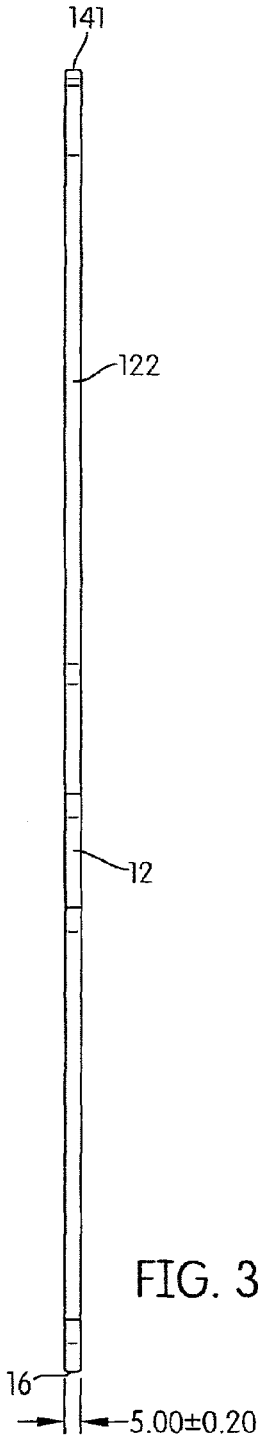
FIG. 31 is a side elevational view of the handle in accordance with another embodiment of the present invention.
Figure 33:
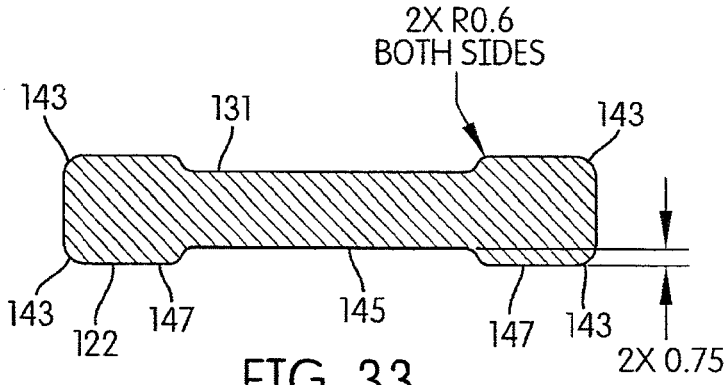
FIG. 33 is a sectional view thereof along the line 33-33 of FIG. 30 in accordance with another embodiment of the present invention.
Figure 34:
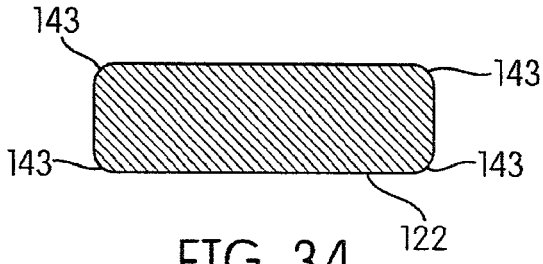
FIG. 34 is a sectional view thereof along the line 34-34 of FIG. 30 in accordance with another embodiment of the present invention.
Figure 35:
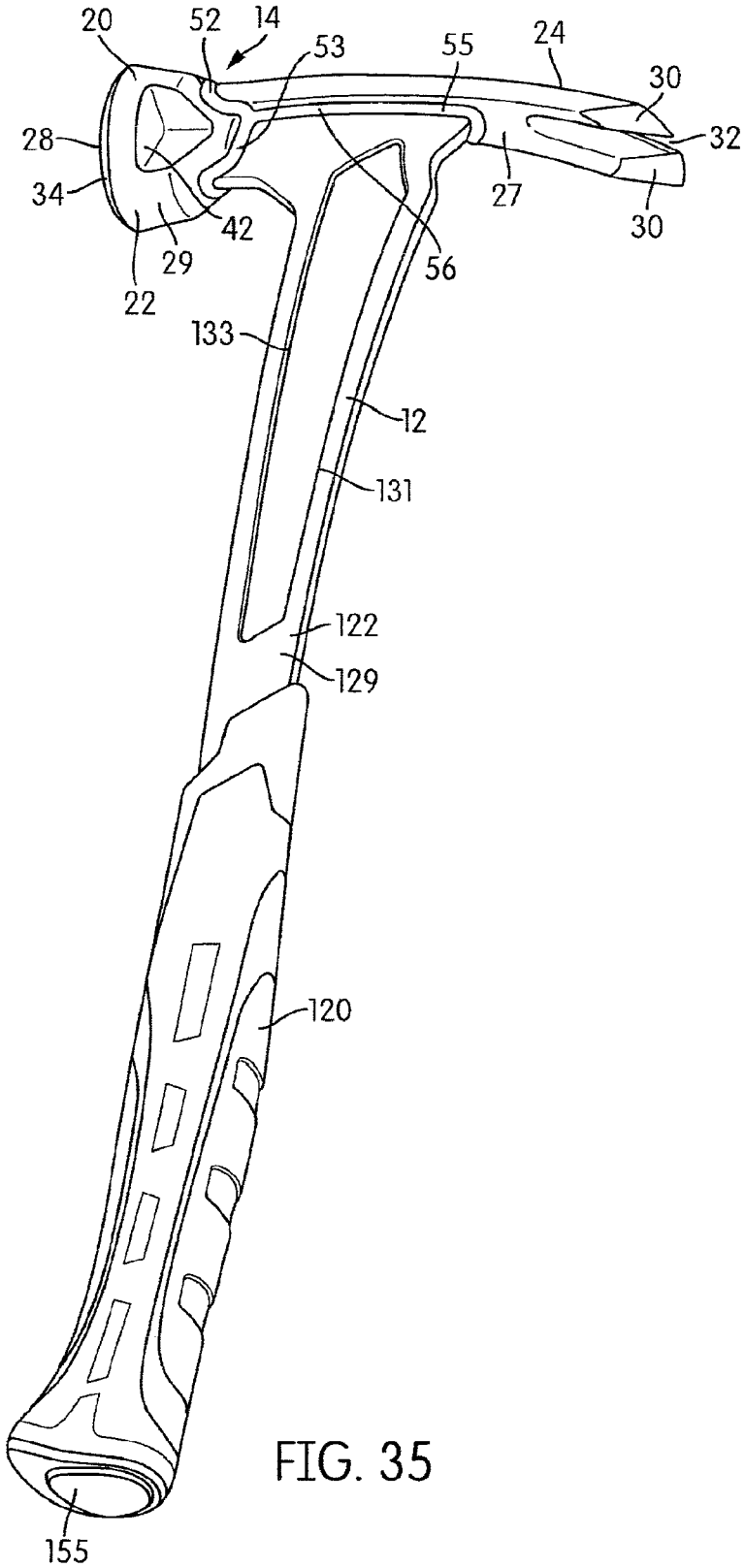
FIG. 35 is an assembled view of the hammer in accordance with another embodiment of the present invention.

FIGS. 26 and 27 show sectional views of the handle core portion 122 (as shown in FIGS. 22-24) along the lines 26-26 and 27-27 of FIG. 24 in accordance with an embodiment of the present invention. FIGS. 33 and 34 show sectional views of the handle core portion 122 (as shown in FIGS. 29-31) along the lines 33-33 and 34-34 of FIG. 30 in accordance with an embodiment of the present invention.

FIG. 26 shows a section view of the handle core portion 122 in a portion in which the recess portion 127 is disposed, while FIG. 33 shows a section view of the handle core portion 122 in a portion in which the recess portion 131 is disposed. As shown in the illustrative embodiments of FIGS. 26 and 33, the handle core portion 122 has an I-shaped cross-sectional configuration in portions where the recess portion 127 or 131 is disposed. Such I-shaped cross-section configuration has a central web portion 145 having a reduced or decreased thickness than the surrounding flange portions 147. Such I-shaped cross-section configuration is configured to increase the strength of the handle core portion while reducing the material usage. Other cross-sectional shapes are also contemplated as within the scope of this invention.

In the illustrative embodiment of FIG. 33, the central web portion 145 has a substantially uniform thickness and the surrounding flange portions 147 have a substantially uniform thickness that is different from the thickness of the central web portion 145.

In another embodiment, as shown in FIG. 26, the central web portion 145 may have varying thickness along the central web portion 145. In one embodiment, the central web portion 145 may have a stepped cross-sectional configuration. In one embodiment, thickness of a central portion 151 of the web portion 145 is lower than the thickness of the surrounding portions 153 of the web portion 145.

FIGS. 27 and 34 show section views of the handle core portions 122 in portions having no recess portions. As shown in the illustrative embodiment of FIGS. 27 and 34, the thickness of the handle core portion is substantially uniform in the portions with no recess portions.

As shown in the cross-sectional views of FIGS. 26 and 27, in one embodiment, the handle core portion 122 has substantially rounded corner portions 143.

Figure 28:
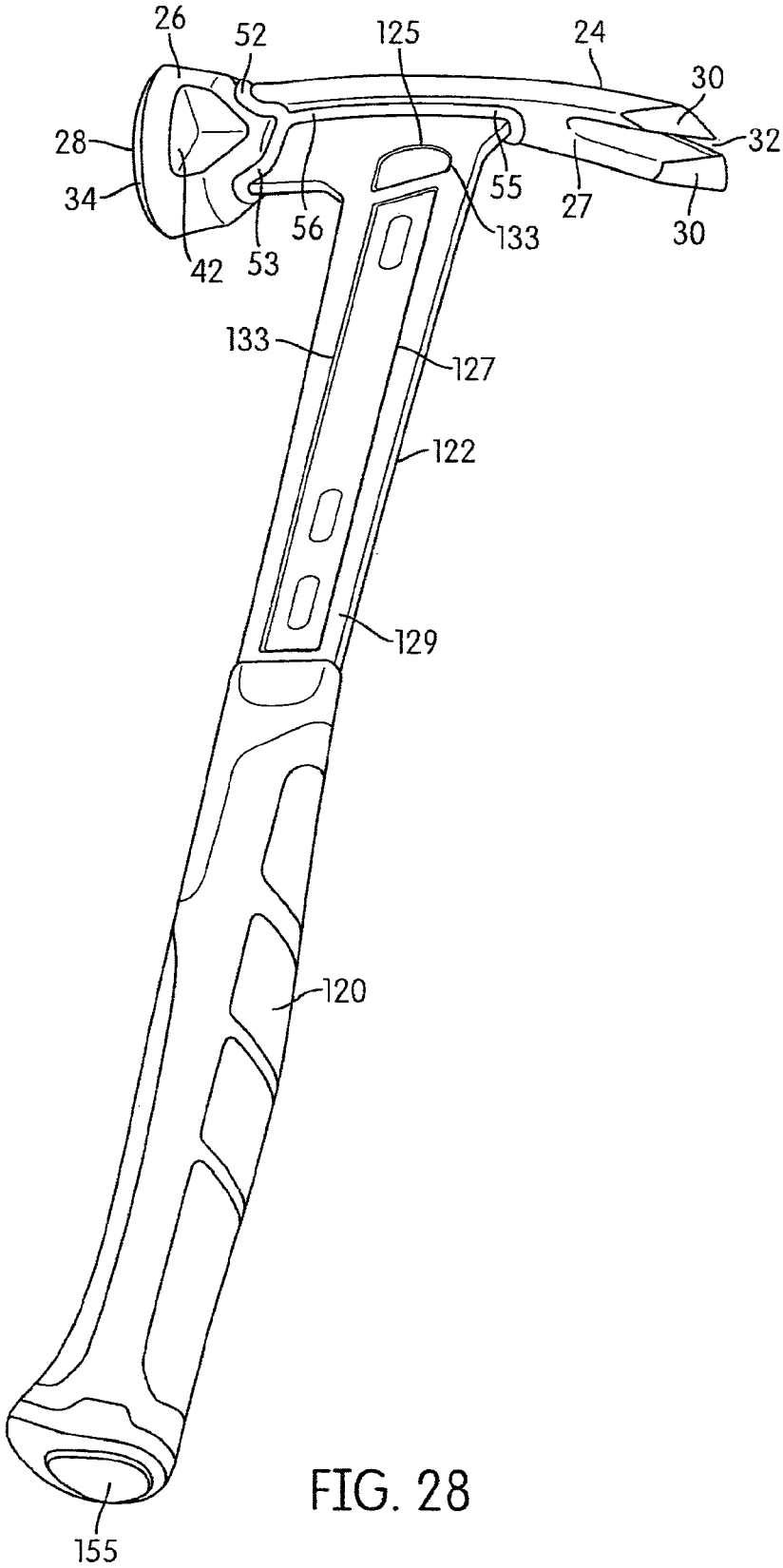
FIG. 28 is an assembled view of the hammer in accordance with an embodiment of the present invention.

FIGS. 28 and 34 show hammers in their assembled view. The hammers in FIGS. 28 and 34 are similar to each other, except for the differences as will noted below.

The hammer shown in FIG. 28 has the handle core portion 122 as shown in FIGS. 22-27, while hammer shown in FIG. 34 has the handle core portion 122 as shown in FIGS. 29-34. In illustrated embodiment, as shown in FIGS. 28 and 34, the grip portions of the hammers are different from each other. In another embodiment, the grip portions of the hammers may be same.

In one embodiment, the components of the hammer, such as the handle 12, the claw portion 24 and the bell portion 20, may be made from any suitable metallic materials that are selected for their intended use and cost. For example, a steel hammer having a weight similar to that of a titanium hammer may be economically produced.

In one embodiment, the handle 12, the claw portion 24, and the bell portion 20 are formed from dissimilar materials. In another embodiment, the claw portion 24 and the bell portion 20 are formed from same material and are connected to the handle 12 formed from a different material. In yet another embodiment, the claw portion 24 and the bell portion 20 are integrally formed from same material and are connected to the handle 12 formed from a different material.

In non-limiting examples, the weight of the hammer 10 having separately formed bell portion, claw portion and handle is nominally between 26.5 and 31.0 ounces; and the overall length dimension of such hammer is between 13.5 and 16.5 inches.

In non-limiting examples, the weight of the hammer 10 having handle and integrally formed bell portion and the claw portion is nominally between 26.5 and 31.0 ounces; and the overall length dimension of such hammer is between 13.5 and 16.5 inches.

The amount of energy a hammer can deliver, called kinetic energy (KE), is a function of the weight of the hammer and the speed at which it travels. The equation 1 provides the formula for Kinetic Energy.

$$\text{Kinetic Energy (KE)} = (1/2) \times m \times v^2 \quad \text{Equation (1)}$$

where m=mass (weight of the hammer)

v=velocity (speed at which the hammer is traveling)

As can be seen from the above Equation (1), velocity (v) has much more influence than mass (m) on the amount of energy the hammer can deliver because the value of velocity is squared. A user typically swings a lighter hammer faster.

For example, a 28 oz (e.g., made by Estwing®) framing hammer, with a total weight of 1.09 kilograms (Kg) may be swung at around 10 meters per second (m/s) of velocity to deliver approximately 55 joules of kinetic energy. In contrast, the hammer of the present application, with a total weight of approximately 0.8 Kilograms (Kgs), may be swung at around 12.2 meters per second (m/s) of velocity to deliver approximately 60 joules of kinetic energy. In one embodiment, the hammer described in the present application weighs 35-40% less than a traditional 28 oz framing hammer.

Figure 36B:
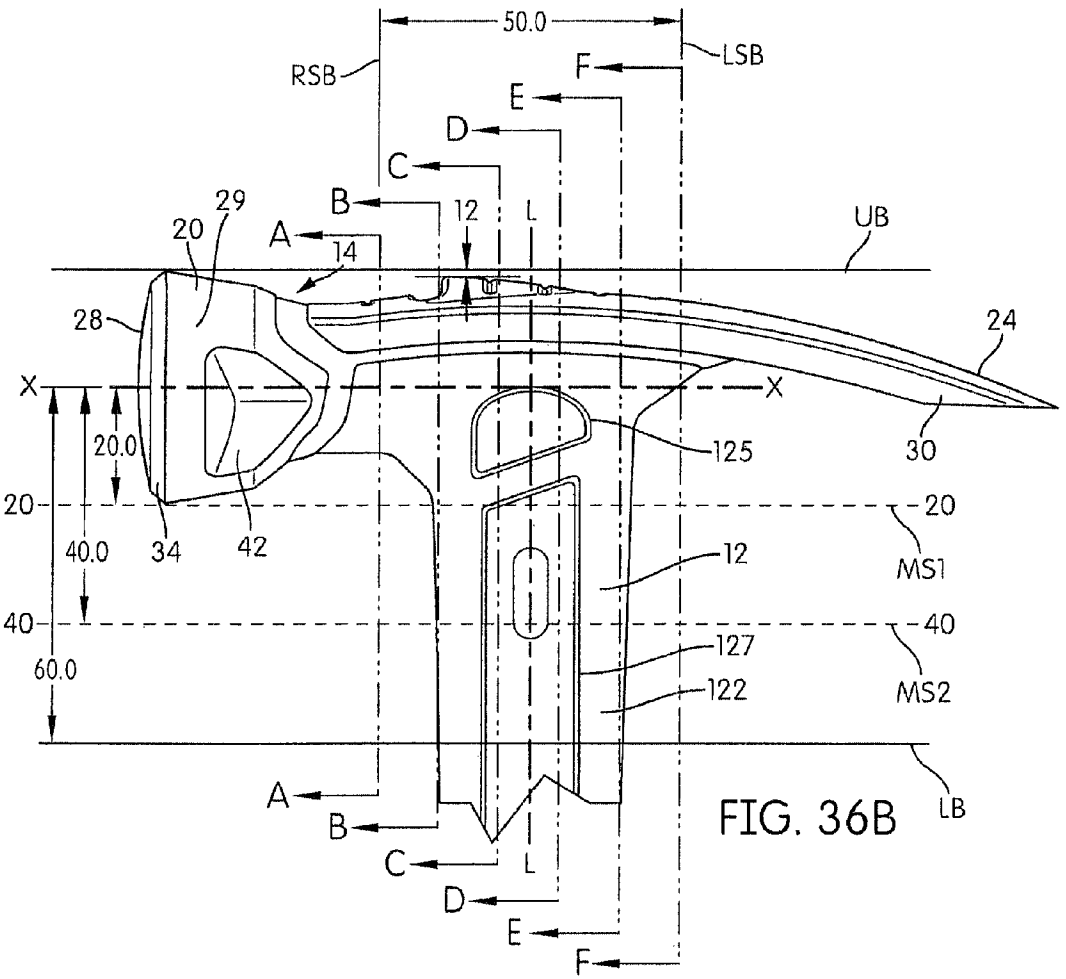
FIG. 36B is a partial left hand side elevational view of the hammer illustrating a central axis of a strike surface of the bell portion in accordance with an embodiment of the present invention.
Figure 36A:
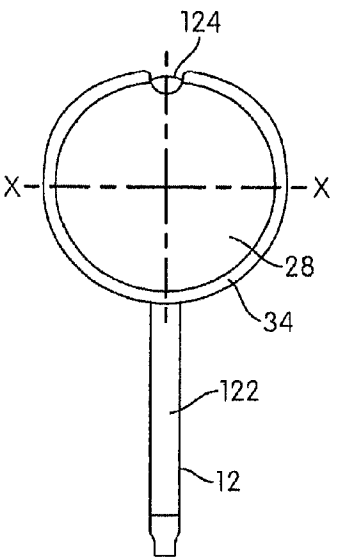
FIG. 36A is a partial front view of the hammer in accordance with an embodiment of the present invention.
Figure 37:
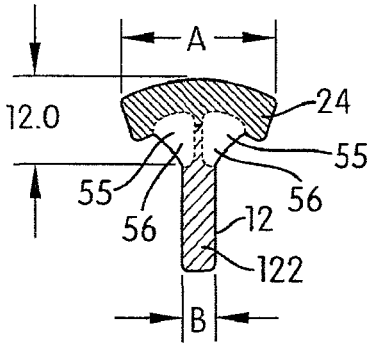
FIG. 37 is a sectional view thereof along the line A-A of FIG. 36B in accordance with an embodiment of the present invention.
Figure 38:
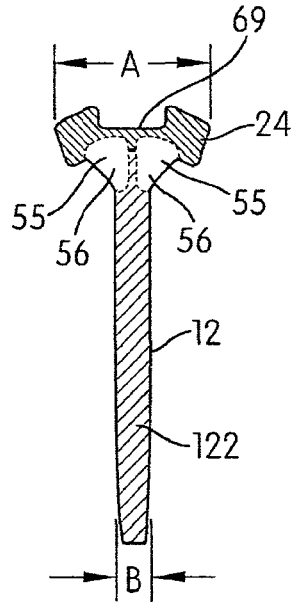
FIG. 38 is a sectional view thereof along the line B-B of FIG. 36B in accordance with an embodiment of the present invention.
Figure 39:
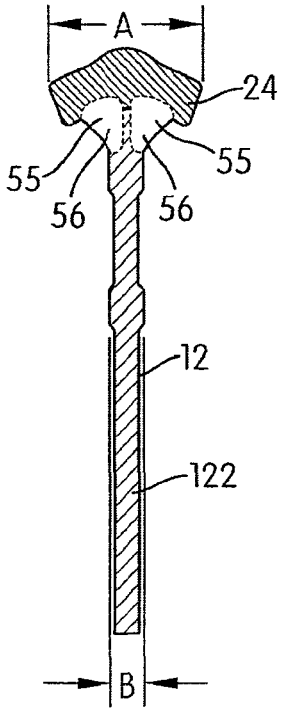
FIG. 39 is a sectional view thereof along the line C-C of FIG. 36B in accordance with an embodiment of the present invention.
Figure 40:
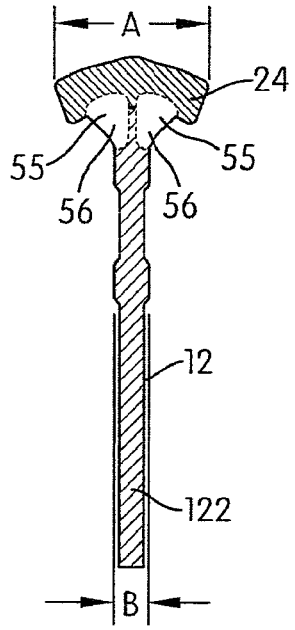
FIG. 40 is a sectional view thereof along the line D-D of FIG. 36B in accordance with an embodiment of the present invention.
Figure 41:
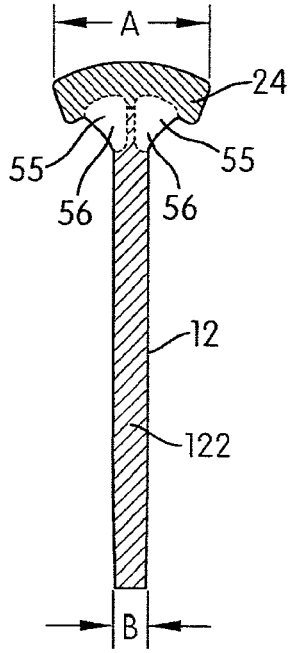
FIG. 41 is a sectional view thereof along the line E-E of FIG. 36B in accordance with an embodiment of the present invention.
Figure 42:
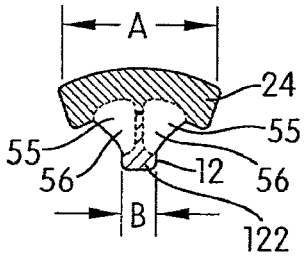
FIG. 42 is a sectional view thereof along the line F-F of FIG. 36B in accordance with an embodiment of the present invention.

FIG. 36A shows a partial front view of the hammer and FIG. 36B shows a partial left hand side elevational view of the hammer 10 illustrating different cross-sections being therethrough in accordance with an embodiment of the present invention. FIGS. 37-42 show the progressive cross-sectional views of the hammer 10 taken along various sections A-A through F-F of FIG. 36B. FIGS. 37-42 show width measurement A of the head 14 and the maximum thickness measurement B of the handle core portion 122 measured at section lines A-A through F-F, respectively.

TABLES 1-3 in FIG. 46 provide a comparison and overview of particular embodiments of the hammer in accordance with the invention disclosed herein in comparison with various hammers across a sampling multiple brands and/or models. Among other things, these tables provide a comparative or a relative measurement of the ratio of width measurement of the head to maximum thickness measurement of the handle for the various hammers.

The top row of each table has a model number of the hammer under consideration. For example, TABLE 1 provides the measurement data for Stanley® FatMax Framing Rip Claw hammer described and shown with respect to FIGS. 29-35 of the present application. TABLES 2 and 3 provide the measurement data for Estwing® 22 ounces Straight Rip Claw Framing Hammer (model number: E322S) and Plumb® (Cooper hand tools) 28 ounces Solid Steel Rip Hammer (model number: SS28RCF), respectively.

The first column in TABLES 1-3 provides a section at which the width measurement of the head and the thickness of the handle are taken. In one embodiment, as shown in FIG. 36B, the sections A-A through F-F are positioned at portions of the hammer 10 where the head 14 adjoins the handle 12. In one embodiment, the sections A-A through F-F are taken generally parallel to a longitudinal axis L-L of the hammer 10, and generally perpendicular to a central axis X-X of the bell portion.

The second column in TABLES 1-3 provides a width measurement A of the head measured at the section. In one embodiment, the width measurement A of the head is a width measurement A of the claw portion. In one embodiment, the width measurement A of the head is measured in millimeters.

The third column in TABLES 1-3 provides a thickness measurement B of the handle measured at the section. In one embodiment, the thickness measurement B of the handle is a maximum thickness measurement B of the handle. As noted above, the handle may include cutouts, recesses portions or reduced thickness portions 125, 127 or 131 disposed thereon. In one embodiment, the maximum thickness measurement B of the handle is a thickness measurement measured at the section at portions of the handle where the thickness of the handle is maximum (i.e., at portions of the handle other than where the cutouts or reduced thickness portions are disposed). In one embodiment, the thickness measurement B of the handle is measured in millimeters.

In the illustrated embodiment, the thickness measurement of the handle is measured in a predefined area. In one embodiment, an upper boundary UB and a lower boundary LB of the predefined area may be parallel to the central axis X-X of the bell portion. In one embodiment, the upper boundary UB of the predefined area is a parallel line that matches the upper contour of the head and is spaced 12 millimeters away from the upper contour of the head. In one embodiment, the lower boundary LB of the predefined area may be parallel to the central axis X-X of the bell portion and is positioned at a longitudinal distance of 60 millimeters from the central axis X-X of the bell portion.

In one embodiment, a right side boundary RSB and a left side boundary LSB of the predefined area may be parallel to the longitudinal axis L-L of the hammer 10. In one embodiment, the right side boundary RSB and the left side boundary LSB are positioned at a distance of 25 millimeters from the longitudinal axis L-L of the hammer 10 and on each side of the longitudinal axis L-L of the hammer 10.

The fourth column in TABLES 1-3 provides a ratio of the width measurement A of the head 14 to the maximum thickness measurement B of the handle 12. In one embodiment, a ratio of the width measurement A of the head 14 to the maximum thickness measurement B of the handle 12 is at least 2.0.

In one embodiment, the ratio of the width measurement A of the head 14 to the maximum thickness measurement B of the handle 12 is within the range of from approximately 4.0 to 5.0.

In one embodiment, the ratio of the width measurement A of the head 14 to the maximum thickness measurement B of the handle 12 is up to 40 percent greater than or up to 40 percent less than those noted in TABLE 1. In one embodiment, the ratio of the width measurement A of the head 14 to the maximum thickness measurement B of the handle 12 is up to 20 percent greater than or up to 20 percent less than those noted in TABLE 1. In one embodiment, the ratio of the width measurement A of the head 14 to the maximum thickness measurement B of the handle 12 is up to 10 percent greater than or up to 10 percent less than those noted in TABLE 1. In one embodiment, the ratio of the width measurement A of the head 14 to the maximum thickness measurement B of the handle 12 is up to 5 percent greater than or up to 5 percent less than those noted in TABLE 1.

In one embodiment, the ratio of the width measurement A of the head 14 to the maximum thickness measurement B of the handle 12 increases as the section lines move further away from the strike face 28.

TABLES 4-7 in FIG. 47 provide a comparison and overview of particular embodiments of the hammer in accordance with the invention disclosed herein in comparison with various hammers across a sampling multiple brands and/or models. Among other things, these tables provide a comparative or a relative measurement of the ratio of maximum width measurement of the handle to maximum thickness measurement of the handle for the various hammers.

The top row of each table has a model number of the hammer under consideration. For example, TABLE 4 provides the measurement data for Stanley® FatMax Framing Rip Claw hammer described and shown with respect to FIGS. 29-35 of the present application. TABLES 5-7 provide the measurement data for EstWing® 22 ounces Straight Rip Claw Framing Hammer (model number: E322S), Plumb® (Cooper hand tools) 28 ounces Solid Steel Rip Hammer (model number: SS28RCF) and Dead On® (Dead On Tools®) 22 ounces 18-Inch Steel Milled Face Hammer (model number: DOS22M), respectively.

The first column in TABLES 4-7 provides measurement sections. The width measurement and thickness measurement of the handle are taken at one or more measurement sections. In one embodiment, the measurement sections taken along a measurement axis parallel to the central axis X-X of the bell portion 20, between 20 millimeters and 40 millimeters below the central axis X-X of the bell portion 20.

In the illustrated embodiment, as shown in FIG. 36B, two measurement sections MS1 and MS2 are shown. The first measurement section MS1 is taken along a measurement axis 20-20 parallel to the central axis X-X of the bell portion 20 and is positioned at 20 millimeters below the central axis X-X of the bell portion 20 and the second measurement section MS2 is taken along a measurement axis 40-40 parallel to the central axis X-X of the bell portion 20 and is positioned at 40 millimeters below the central axis X-X of the bell portion 20. In one embodiment, width measurement and thickness measurement of the handle are taken at one or more measurement sections that are placed between the measurement sections MS1 and MS2.

The second column in TABLES 4-7 provides a width measurement of the handle measured at the measurement section. In one embodiment, the width measurement of the handle is a maximum width measurement of the handle. In one embodiment, the width measurement of the handle is measured in millimeters.

The third column in TABLES 4-7 provides a thickness measurement of the handle measured at the measurement section. In one embodiment, the thickness measurement of the handle is a maximum thickness measurement of the handle. In one embodiment, the thickness measurement of the handle is measured in millimeters.

The fourth column in TABLES 4-7 provides a ratio of the maximum width measurement to the maximum thickness measurement of the handle. In one embodiment, a ratio of the maximum width measurement to the maximum thickness measurement of the handle is at least 3.5.

In one embodiment, the ratio of the maximum width measurement to the maximum thickness measurement of the handle is within the range of from approximately 5.8 to 6.6.

In one embodiment, the ratio of the maximum width measurement to the maximum thickness measurement of the handle is up to 40 percent greater than or up to 40 percent less than those noted in TABLE 4. In one embodiment, the ratio of the maximum width measurement to the maximum thickness measurement of the handle is up to 20 percent greater than or up to 20 percent less than those noted in TABLE 4. In one embodiment, the ratio of the maximum width measurement to the maximum thickness measurement of the handle is up to 10 percent greater than or up to 10 percent less than those noted in TABLE 4. In one embodiment, the ratio of the maximum width measurement to the maximum thickness measurement of the handle is up to 5 percent greater than or up to 5 percent less than those noted in TABLE 4.

As can be appreciated from TABLES 4-7 and 8, in one aspect of the hammer of the present invention, the weight of the present hammer is distributed such that it is less top heavy than prior art hammers. This weight distribution allows the hammer to be swung faster (with more velocity), imparting more kinetic energy in comparison with a hammer of equal weight, but in which there is more relative weight in the head.

In one embodiment, the ratio of the maximum width measurement to the maximum thickness measurement of the handle 12 decreases as the measurement sections move further away from the central axis X-X of the bell portion 20.

In one embodiment, a method of making a hammer includes forming the handle core portion 122 from sheet metal; forming the claw portion 24; forming the bell portion 20; connecting or securing the sheet metal handle 122 to the bell portion 20; connecting or securing the claw portion 24 and the bell portion 20; and pressing or over-molding the manually gripping portion 120 onto the handle 12.

In one embodiment, a first piece of sheet metal is stamped to form the handle 12, a second piece of metal is hot forged to form the claw portion 24 and a third piece of metal is cold forged to form the bell portion 20.

In other embodiments, as noted above, the handle 12 may be formed from laser cutting, water jet cutting, fine blanking, plasma cutting, electrochemical machining, electrical discharge machining, cold forging, hot forging, milling, die cutting, computer numeric controlled machining operation, or any other suitable machining process, the claw portion 24 may be formed from cold forming, forging, casting, rolling, extrusion, or metal injection molding, and the bell portion 20 may be formed from hot forging, cold forming, cold heading, casting, rolling, extrusion, metal injection molding (MIM), or formed from stamped sheet metal.

In one embodiment, because a separately formed handle, made from sheet metal, is connected to the head (e.g., by being welded), this permits for the creation of unusual handle shapes (by stamping, laser cutting, etc.), particularly at the transition between the handle and head, and elsewhere in the handle. This enables the hammer to be provided with one or more of enhanced aerodynamics, weight distributions, ergonomics and/or design attributes. The sheet metal also provides the handle with a relatively thin front view profile or dimension (as shown in FIG. 31) in comparison to its side profile (as shown in FIG. 30) in terms of the ratio therebetween, while also maintaining the head with relatively wide strike face (as can be appreciated from FIG. 4). These various aspects and relative measurements can be appreciated from this specification and drawings taken as a whole.

In one embodiment, the bell portion 20 and the claw portion 24 are separately formed structures. In one embodiment, the portion 60 of the claw portion 24 is received in the claw portion receiving portion 58 of the bell portion 20 and the weld connection 52 connects the bell portion 20 with the claw portion 24 to secure them with each other. In one embodiment, the portion 61 of the handle core portion 122 is received in the handle receiving portion 59 of the bell portion 20 and the weld connection 53 connects the bell portion 20 with the handle core portion 122 to secure them with each other. In one embodiment, the surface 141 of the handle core portion 122 rests against the surface 27 of the claw portion 24 and the weld connection 55 connects the claw portion 24 with the handle 12 to secure them with each other.

In one embodiment, the welding operation may include a Gas Metal Arc Welding (GMAW) or a Metal Inert Gas Welding (MIGW). For example, in GMAW process, a continuous and consumable wire electrode and a shielding gas are fed through a welding gun to make the weld connection.

In one embodiment, individual hammer components (handle, claw portion and bell portion) are manually loaded into a welding fixture and a MIG (Metal Inert Gas) welding operation is performed by a robot for strong and consistent welds. Other known welding operations may alternatively be used. Exemplary weld operations used to connect or secure the portions of the hammer are described in detail in a U.S.

patent Ser. No. 12/827,484, filed on Jun. 30, 2010, the entirety of which is hereby incorporated into the present application by reference.

In one embodiment, the claw portion 24 and the bell portion 20 are integrally formed as one-piece structures. In one embodiment, the weld connection 56 connects the stamped sheet metal handle 122 with integrally formed claw portion and bell portion. In one embodiment, the portion 61 of the handle core portion 122 is received in the handle receiving portion 59 of the bell portion 20 and the surface 141 of the handle core portion 122 rests against the surface 27 of the claw portion 24 as the weld connection 56 connects the stamped sheet metal handle 122 with integrally formed claw portion and bell portion.

FIGS. 43-45 illustrate an alternative embodiment in accordance with various aspects of the present invention. This embodiment is similar to the embodiments previously described, except for the differences as will be noted below.

In the embodiment, as shown in FIGS. 43-45, the claw portion 24 and the bell portion 20 are integrally formed as one-piece structures. In one embodiment, the weld connection 56 connects the stamped sheet metal handle 122 with integrally formed claw portion and bell portion. In one embodiment, the portion 61 of the handle core portion 122 is received in the handle receiving portion (not shown) of the bell portion 20 and the surface 141 of the handle core portion 122 rests against the surface 27 of the claw portion 24 as the weld connection 56 connects the stamped sheet metal handle 122 with integrally formed claw portion and bell portion.

In the embodiment, as shown in FIGS. 43-45, the handle core portion 122 is similar to that shown in FIGS. 22 and 23. In another embodiment, the handle core portion 122 that is similar to one shown in FIGS. 29 and 30 may be used instead. The hammer shown in FIGS. 43-45 may optionally include a nail starter arrangement similar to the one described above.

FIG. 49 shows a TABLE 8 which provides a comparison and overview of particular embodiments of the hammers in accordance with various aspects of the present disclosure, in comparison with various prior art hammers across a sampling of multiple brands and/or models.

For example, rows one through nine of TABLE 8 provide the measurement data for various prior art hammers across a sampling multiple brands and/or models. In contrast, the last two rows (i.e., rows twelve and ten and eleven) of TABLE 8 provide the measurement data for Dewalt® framing hammer (shown with respect to FIGS. 1-7) and Dewalt® rip claw hammer both representing various embodiments of the present disclosure.

Among other things, this table provides a comparative or a relative measurement of the ratio of the weight of the head to the weight of the handle for the various hammers; a comparative or a relative measurement of the ratio of the overall weight or mass of the hammer to the weight of the head for the various hammers; a comparative or a relative measurement of the ratio of the overall weight or mass of the hammer to the weight of the handle for the various hammers; a comparative or a relative measurement of the ratio of the weight of the head to the overall length dimension OAL of the hammer for the various hammers; a comparative or a relative measurement of the ratio of the weight of the handle to the overall length dimension OAL of the hammer for the various hammers; and a comparative or a relative measurement of the ratio of the overall weight or mass of the hammer to the overall length dimension OAL of the hammer for the various hammers.

The first, the second and the third columns in TABLE 8 provide manufacturer name, model number, and brief description, respectively of the hammer under consideration.

The brief description of the hammer may include information related to the type of the hammer under consideration, nominal weight listed on the hammer under consideration and/or information related to the type or the style of the claw disposed on the head of the hammer under consideration. For example, the type of the hammer may include framer type hammer or nailer type hammer. The type or the style of the claw may include rip-type or claw-type.

Note that the weight of the hammer nominally listed on the hammer itself is an approximate measure of the weight of the head and is not the weight of the entire hammer. The overall weight of the hammer is higher than the weight listed and this overall weight of the hammer is provided in column five of TABLE 8.

Alternative descriptive information for some models is also provided for identification purposes as will be appreciated by those skilled in the art. For example, the surface finish (e.g., checkered or smooth) of the strike face was provided for some models. For example, Dewalt® framing hammer of the present application, under consideration in TABLE 8, includes a checkered strike face.

The fourth column in TABLE 8 provides the overall length dimension OAL, which is the total maximum axial height of the entire hammer (as shown in FIG. 2), of the hammer under consideration. The overall length dimensions OALs of the hammer under consideration is measured in inches. For example, the overall length dimension OAL of Dewalt® framing hammer and Dewalt® rip claw hammer of the present application, under consideration in TABLE 8, are 16 inches and 14 inches, respectively.

The fifth column in TABLE 8 provides overall mass or weight, measured in ounces, of the hammer under consideration. The overall weight or mass of the hammer is higher than the weight nominally listed on the hammer. The overall weight or mass of the hammer includes the weight of the entire hammer. For example, the overall masses or weights of Dewalt® framing hammer and Dewalt® rip claw hammer of the present application, under consideration in TABLE 8, are 30.28 ounces and 27.20 ounces, respectively.

The sixth column in TABLE 8 provides a weight of the head, measured in ounces, of the hammer under consideration. For example, the head masses or weights of Dewalt® framing hammer and Dewalt® rip claw hammer of the present application, under consideration in TABLE 8, are 15.08 ounces and 13.50 ounces, respectively.

The seventh column in TABLE 8 provides a weight of the handle, measured in ounces, of the hammer under consideration. For example, the handle masses or weights of Dewalt® framing hammer and Dewalt® rip claw hammer of the present application, under consideration in TABLE 8, are 15.20 ounces and 13.70 ounces, respectively.

Figure 48:
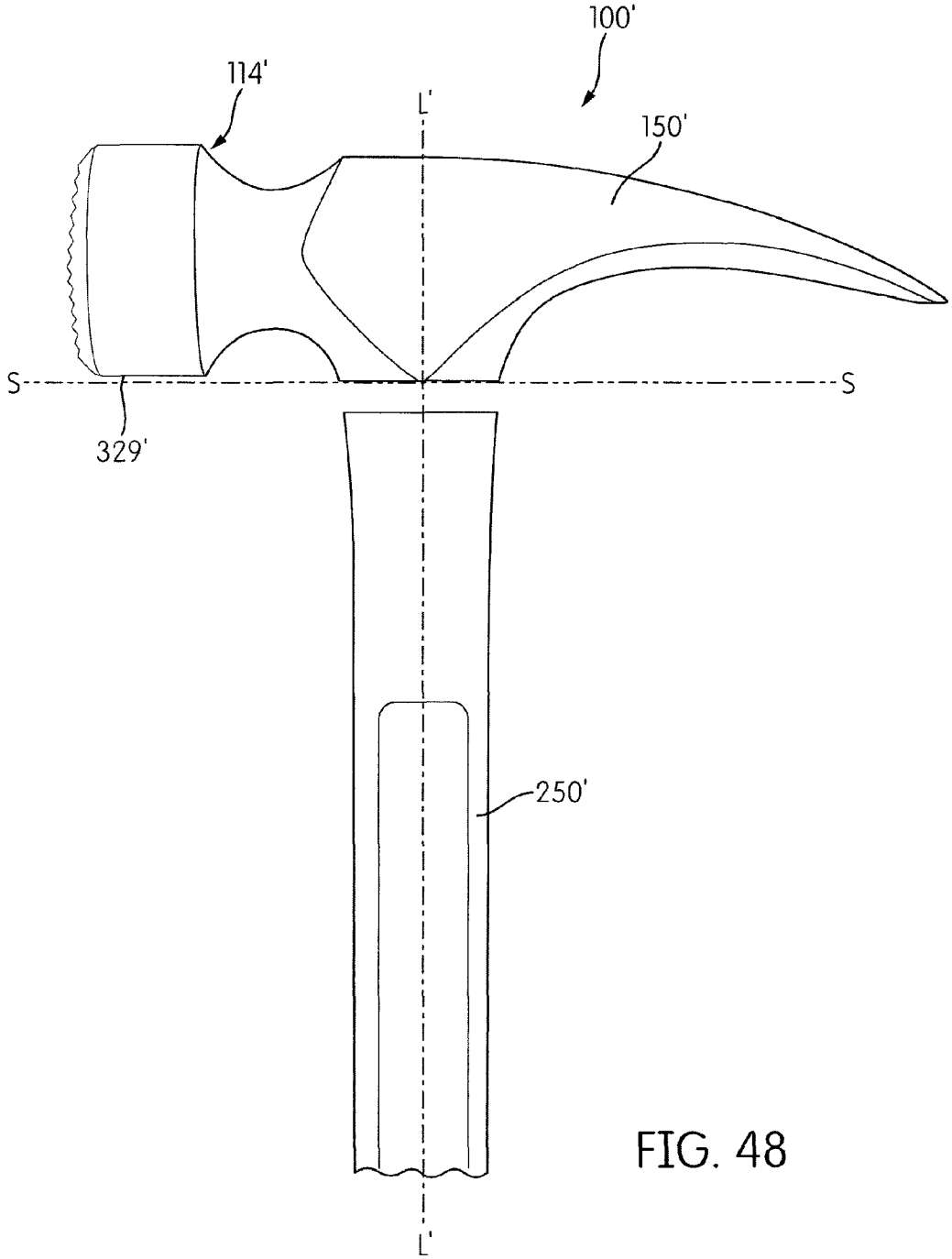
FIG. 48 shows an exemplary hammer being sectioned as shown in order to obtain weight of the head and weight of the handle.

The weight of the head and the weight of the handle of the hammer under consideration were measured by sectioning the hammer as shown in FIG. 48. As shown in FIG. 48, the hammer 100' was cut along a section S-S, where the section S-S is disposed at a tangent to a bottom most end 329' of the head 114' and is perpendicular to the centerline L'-L' of the hammer handle. In one embodiment, the bottom-most axial point of the head 114' is disposed at a bottom surface of the bell portion. In one embodiment, the hammers under consideration were cut along their respective sections S-S using an electro discharge machine (EDM) during which a negligible amount of material was lost.

After performing the cutting operation, the weight of head 150' and the weight of the handle 250' were measured and are provided in columns six and seven, respectively. The overall length dimension OAL and the overall weight or mass of the hammers under consideration were measured prior to the cutting operation and are provided in columns four and five, respectively.

The eighth column in TABLE 8 provides a ratio of the weight of the head to the weight of the handle of the hammer under consideration. The weight of the head and the weight of the handle are both measured in ounces.

In one embodiment, a ratio of the weight of the head to the weight of the handle of the hammer is less than 1.02.

In one embodiment, the ratio of the weight of the head to the weight of the handle of the hammer is within the range of from approximately 0.80 to 1.02. In one embodiment, the ratio of the weight of the head to the weight of the handle of the hammer is 0.99.

The ninth column in TABLE 8 provides a ratio of the overall weight or mass of the hammer to the weight of the head of hammer under consideration. The overall weight of the hammer and the weight of the head of the hammer are both measured in ounces.

In one embodiment, a ratio of the overall weight or mass of the hammer to the weight of the head of hammer is at least 1.98.

In one embodiment, the ratio of the overall weight or mass of the hammer to the weight of the head of hammer is within the range of from approximately 1.98 and 2.40. In one embodiment, the ratio of the overall weight or mass of the hammer to the weight of the head of hammer is 2.01.

The tenth column in TABLE 8 provides a ratio of the overall weight of the hammer to the weight of the handle of hammer under consideration. The overall weight of the hammer and the weight of the handle of the hammer are measured in ounces.

In one embodiment, a ratio of the overall weight of the hammer to the weight of the handle of hammer is less than 2.02.

In one embodiment, the ratio of the overall weight of the hammer to the weight of the handle of hammer is within the range of from approximately 1.60 and 2.02. In one embodiment, the ratio of the overall weight of the hammer to the weight of the handle of hammer is 1.99.

The eleventh column in TABLE 8 provides a ratio of the weight of the head of the hammer to the overall length dimension (OAL) of hammer under consideration. The overall length dimension (OAL) of hammer is measured in inches and the weight of the head of the hammer is measured in ounces.

In one embodiment, a ratio of the weight of the head of the hammer to the overall length dimension (OAL) of hammer is less than 1.10.

In one embodiment, the ratio of the weight of the head of the hammer to the overall length dimension (OAL) of hammer is within the range of from approximately 0.75 and 1.10. In one embodiment, the ratio of the weight of the head of the hammer to the overall length dimension (OAL) of hammer is 0.96. In another embodiment, the ratio of the weight of the head of the hammer to the overall length dimension (OAL) of hammer is 0.94.

The twelfth column in TABLE 8 provides a ratio of the weight of the handle of the hammer to the overall length dimension (OAL) of hammer under consideration. The overall length dimension (OAL) of hammer is measured in inches and the weight of the handle of the hammer is measured in ounces.

In one embodiment, the ratio of the weight of the handle of the hammer to the overall length dimension (OAL) of hammer is 0.95. In another embodiment, the ratio of the weight of the handle of the hammer to the overall length dimension (OAL) of hammer is 0.98.

The thirteenth column in TABLE 8 provides a ratio of the overall weight of the hammer to the overall length dimension (OAL) of hammer under consideration. The overall length dimension (OAL) of hammer is measured in inches and the overall weight of the hammer is measured in ounces.

In one embodiment, a ratio of the overall weight of the hammer to the overall length dimension (OAL) of hammer is less than 2.10.

In one embodiment, the ratio of the overall weight of the hammer to the overall length dimension (OAL) of hammer is within the range of from approximately 1.50 and 2.10. In one embodiment, the ratio of the overall weight of the hammer to the overall length dimension (OAL) of hammer is 1.89. In another embodiment, the ratio of the overall weight of the hammer to the overall length dimension (OAL) of hammer is 1.94.

Although the invention has been described in detail for the purpose of illustration, it is to be understood that such detail is solely for that purpose and that the invention is not limited to the disclosed embodiments, but, on the contrary, is intended to cover modifications and equivalent arrangements that are within the spirit and scope of the appended claims. In addition, it is to be understood that the present invention contemplates that, to the extent possible, one or more features of any embodiment can be combined with one or more features of any other embodiment.

What is claimed is:

1. A hammer comprising:

a handle having a bottom end and an upper end, the handle comprising a steel core portion and a manually engageable grip portion surrounding a part of the steel core portion, the grip portion comprising an elastomeric material, a rubber based material, or a plastic based material; and a steel head disposed on the upper end of the handle, the head having a steel bell portion and a steel claw portion, wherein a bell portion axis extends centrally through the bell portion, wherein a longitudinal axis of the hammer extends longitudinally through the handle, wherein the hammer has a first thickness defined as a maximum side-to-side thickness within a portion of the hammer disposed between: (a) an upper boundary defined by the bell portion axis, (b) a lower boundary disposed 60 mm below the bell portion axis, (c) a forward boundary disposed 5 mm forward of the longitudinal axis, and (d) a rearward boundary disposed 25 mm rearward of the longitudinal axis, wherein the hammer has a claw thickness defined as a maximum side-to-side thickness of the hammer within a portion of the hammer disposed above the bell portion axis and between a forward boundary disposed 5 mm forward of the longitudinal axis and a rearward boundary disposed 25 mm rearward of the longitudinal axis, and a ratio of the claw thickness to the first thickness is larger than 2.8.

2. A hammer comprising:

a handle having a bottom end and an upper end, the handle comprising a steel core portion and a manually engageable grip portion surrounding a part of the steel core portion, the grip portion comprising an elastomeric material, a rubber based material, or a plastic based material; and a steel head disposed on the upper end of the handle, the head having a steel bell portion and a steel claw portion, wherein a bell portion axis extends centrally through the bell portion, wherein the bell portion has a maximum side-to-side bell portion width that is measured perpendicular to the bell portion axis, wherein a longitudinal axis of the hammer extends longitudinally through the handle, wherein the hammer has a first thickness defined as a maximum side-to-side thickness within a portion of the hammer disposed between: (a) an upper boundary defined by the bell portion axis, (b) a lower boundary disposed 60 mm below the bell portion axis, (c) a forward boundary disposed 5 mm forward of the longitudinal axis, and (d) a rearward boundary disposed 25 mm rearward of the longitudinal axis, and wherein a ratio of the maximum bell portion width to the first thickness of the hammer is larger than 4.6.

3. The hammer of claim 2, wherein the claw portion comprises a pair of tapered, forked nail removing members that laterally diverge from each other as they progress away from the bell portion, thereby providing a V-shaped space therebetween.

4. The hammer of claim 2, wherein the ratio is larger than 5.1.

5. The hammer of claim 2, wherein the ratio is larger than 6.1.

6. The hammer of claim 2, wherein the first thickness is less than 8 mm.

7. The hammer of claim 2, wherein:

the hammer has a claw thickness defined as a maximum side-to-side thickness of the hammer within a portion of the hammer disposed above the bell portion axis and between a forward boundary disposed 5 mm forward of the longitudinal axis and a rearward boundary disposed 25 mm rearward of the longitudinal axis; and a ratio of the claw thickness to the first thickness is larger than 2.8.

8. The hammer of claim 2, wherein:

the hammer has a second thickness defined as a maximum side-to-side thickness of the hammer as measured in a cross-section that is parallel to and disposed 20 mm below the bell portion axis, and wherein a ratio of the maximum bell portion width to the second thickness of the hammer is larger than 4.6.

9. The hammer of claim 2, wherein:

the hammer has a third thickness defined as a maximum side-to-side thickness of the hammer as measured in a cross-section that is that is (a) tangent to a bottom most part of the bell portion and (b) parallel to the bell portion axis, and wherein a ratio of the maximum bell portion width to the third thickness of the hammer is larger than 4.6.

10. The hammer of claim 2, wherein:

the hammer has a second thickness defined as a maximum side-to-side thickness of the hammer as measured in a cross-section that is parallel to and disposed 20 mm below the bell portion axis;

the hammer has a front-to-back width defined in the cross-section that is parallel to and disposed 20 mm below the bell portion axis; and a ratio of the front-to-back width to the second thickness is between 3.8 and 9.0.

11. The hammer of claim 10, wherein the ratio of the front-to-back width to the second thickness is between 5.1 and 7.7.

12. The hammer of claim 2, wherein the handle has a substantially straight longitudinal centerline.

13. The hammer of claim 12, wherein said claw portion has an arcuate, substantially plate shaped appearance as viewed in a plane that is parallel to both the longitudinal axis and the bell portion axis.

14. The hammer of claim 2, wherein:

a plurality of recesses are disposed in each lateral side of the steel core portion;

a through hole is disposed near a lower end of the steel core portion;

the steel core portion has a substantially uniform thickness except at portions of the steel core portion where the plurality of recesses are disposed.

15. The hammer of claim 14, wherein indicia identifying the hammer is disposed in at least one of the plurality of recesses.

16. The hammer of claim 2, wherein, in a cross-section of the steel core portion of the handle taken in a plane that is perpendicular to the longitudinal axis, the core portion has a central web portion that is less thick than forward and rearward flange portions disposed forwardly and rearwardly, respectively, of the central web portion.

17. The hammer of claim 16, wherein the cross-section is disposed 60 mm below an intersection between the longitudinal and bell portion axes.

18. The hammer of claim 2, wherein the steel core portion of the handle is between 357 mm and 437 mm long, as measured along the longitudinal axis.

19. The hammer of claim 2, wherein the head and handle core portion are separately formed steel structures.

20. The hammer of claim 2, wherein the head is welded to the handle core portion.

21. The hammer of claim 2, wherein:

the hammer has a head weight defined as a weight of the hammer disposed above a plane that is (a) tangent to a bottom most part of the bell portion and (b) perpendicular to the longitudinal axis; and a ratio of the head weight measured in ounces to an overall length dimension of the hammer measured in inches is less than 1.10.

22. The hammer of claim 21, wherein ratio of the head weight measured in ounces to the overall length dimension of the hammer measured in inches is 0.75 or larger.

23. The hammer of claim 2, wherein:

the hammer has a head weight defined as a weight of the hammer disposed above a plane that is (a) tangent to a bottom most part of the bell portion and (b) perpendicular to the longitudinal axis; and a ratio of an overall weight of the hammer measured in ounces to the head weight measured in ounces is at least 1.98.

24. The hammer of claim 23, wherein the ratio of the overall weight of the hammer measured in ounces to the head weight measured in ounces is less than 2.4 or less.

25. The hammer of claim 2, wherein as viewed in a cross-section through the bell portion in a plane that is perpendicular to the bell portion axis, the bell portion is substantially circular, except for an upper nail-receiving groove disposed along a top of the bell portion.

26. The hammer of claim 2, wherein, as viewed from the side, a forward edge of the steel core portion of the handle includes:

a first linear edge portion that diverges from the longitudinal axis by a first angle as the first linear edge portion progresses upwardly, a second linear edge portion that diverges from the longitudinal axis by a second angle as the second linear edge portion progresses upwardly, the second angle being larger than the first angle, a bottom of the second linear edge portion angularly intersecting a top of the first linear edge portion, and a third linear edge portion that is generally parallel to the bell portion axis, a top of the second linear edge portion angularly intersecting a rearward end of the third linear edge portion, a forward end of the third linear edge abutting the bell portion.

27. The hammer of claim 2, wherein, as viewed from the side, a rearward edge of the steel core portion of the handle includes:

a first linear edge portion that diverges from the longitudinal axis by a first angle as the first linear edge portion progresses upwardly, and a second linear edge portion that diverges from the longitudinal axis by a second angle as the second linear edge portion progresses upwardly, the second angle being larger than the first angle, a bottom of the second linear edge portion angularly intersecting a top of the first linear edge portion, a top of the second linear edge portion abutting the claw portion.

28. The hammer of claim 2, wherein, as viewed from the side, forward and rearward edges of the steel core portion linearly diverge from each other as they extend toward the head.

29. The hammer of claim 2, wherein an overall length of the hammer is between 13.5 and 16.5 inches.

30. The hammer of claim 2, wherein an overall weight of the hammer is between 26.5 and 31.0 ounces.

31. The hammer of claim 2, wherein the grip portion is molded.

32. The hammer of claim 2, wherein the bell portion axis and longitudinal axis are generally perpendicular to each other.

33. The hammer of claim 1, wherein the ratio of the claw thickness to the first thickness is larger than 3.8.

34. The hammer of claim 33, wherein the ratio of the claw thickness to the first thickness is less than 6.6.

35. The hammer of claim 1, wherein:

the hammer has a second thickness defined as a maximum side-to-side thickness of the hammer as measured in a cross-section that is parallel to and disposed 20 mm below the bell portion axis, and a ratio of the claw thickness to the second thickness is larger than 2.8.

36. The hammer of claim 1, wherein the handle has a substantially straight longitudinal centerline.

* * * * *

UNITED STATES PATENT AND TRADEMARK OFFICE

CERTIFICATE OF CORRECTION

PATENT NO. : 8,534,643 B2
APPLICATION NO. : 13/605151
DATED : September 17, 2013
INVENTOR(S) : Keith M. Lombardi et al.

It is certified that error appears in the above-identified patent and that said Letters Patent is hereby corrected as shown below:

On title page, item (54) and in the Specification, Column 1, line 1, Title
replace "WELDED HAMMER"
with --HAMMER--.

Signed and Sealed this
Twelfth Day of November, 2013

Teresa Stanek Rea

Teresa Stanek Rea
*Deputy Director of the United States Patent and Trademark Office*